US005626430A

United States Patent [19]

Bistrack

[11] Patent Number: 5,626,430

[45] Date of Patent: May 6, 1997

[54] ADAPTABLE PRESSURING WRITING INSTRUMENT HOLDER

[76] Inventor: Carl Bistrack, 301 Heights La., Apt. 15F, Feasterville, Pa. 19047

[21] Appl. No.: 237,552

[22] Filed: May 3, 1994

Related U.S. Application Data

[63] Continuation-in-part of Ser. No. 968,210, Oct. 29, 1992, abandoned, which is a continuation-in-part of Ser. No. 652,067, Feb. 7, 1991, Pat. No. 5,180,239.

[51] Int. Cl.[6] ..... B43K 23/00

[52] U.S. Cl. ..... 401/6; 401/7; 401/88; 15/443

[58] Field of Search ..... 401/6, 7, 88; 15/443

[56] References Cited

U.S. PATENT DOCUMENTS

| | | | |
|---|---|---|---|
| D. 298,439 | 11/1988 | Rusk | 401/6 X |
| 1,395,793 | 11/1921 | Broschart | 401/6 |
| 4,526,547 | 7/1985 | Rusk | 401/6 X |
| 4,832,604 | 5/1989 | Rusk | 401/6 X |
| 5,143,463 | 9/1992 | Pozil et al. | 401/6 |

*Primary Examiner*—Steven A. Bratlie

*Attorney, Agent, or Firm*—Louis Weinstein

[57] ABSTRACT

A held writing instrument holder for persons with or without physical disabilities. A central bore with several flat slits enables insertion of instruments of varying shapes. One version has an hour glass-shaped body with a truncated periphery forming a gripping surface with a curved concave surface portion enabling a variety of grips to accommodate the user.

1 Claim, 15 Drawing Sheets

ADAPTABLE PRESSURING WRITING INSTRUMENT HOLDER

CROSS-REFERENCE TO RELATED APPLICATIONS

The present application is a continuation-in-part application of U.S. application Ser. No. 07/968,210, filed Oct. 29, 1992, abandoned, which is a continuation-in-part application of U.S. application Ser. No. 07/652,067, filed Feb. 7, 1991, now U.S. Pat. No. 5,180,239.

BACKGROUND

1. Field of the Invention

This invention relates to hand held writing instrument holders, more specifically to those holders designed for persons with writing disabilities and handicaps, and that offer, to both handicapped and normal persons more writing comfort and alternative methods of holding and applying minimal pressure control to a narrow or wide instrument other than the conventional use of significant pressing forces applied by the thumb, index and middle finger of the gripping hand.

2. Description of Prior Art

There are many people who have difficulty holding and using writing instruments or cannot use them because of limited, varying, or minimal hand or finger gripping ability. This may be the result of a number of conditions ranging from brain impairment to severe cases of arthritis of the hand, digital deformities, missing fingers, or merely a single sprained, cut, broken or cramped finger or hand or group of fingers. Hand injuries are very common among younger persons, as is arthritis to the older population.

It has been found through AARP (American Association of Retired Persons) research that arthritis, or inflammation of the joints is the most common condition affecting people in the United States. Inflammation of the finger joints will affect functionality to varying degrees from a mild pain causing discomfort from the prolonged holding and use of a writing or other instrument, to the more severe form of arthritis which may cause a deformity of the fingers rendering them misshapen for conventional use in grasping or holding a narrow diameter object using the conventional three fingers to apply direct pressure to the instrument for the control of the instrument. Due to the wide range of user's needs it is not an easy or practical task to design a device which will take into account the variety and shapes of support needed to accommodate every instance of hand or finger injury or deformity.

No such device has been made readily available for every day use, nor is there a device that gives the appearance of a prosthetic device used by "cripples", that is simple and common, that is inexpensive to manufacture, to the extent that it might be a "use and throw away" off-the-shelf disposable item, as common as a pen or pencil which is gripped by the device.

A number of devices have been patented which resolve a very specific comfort range, or type or impairment or designated task such as:

"Implement Holding Cuff" by Bischoff et al. U.S. Pat. No. 4,602,885, July 1986, which is designed for the physically handicapped and will contain a hand, fingers, and instrument within a controllable cage or cuff to cradle a non-functioning hand.

"Rolling Support for Writing Instruments" of Russell A. Schroeder, Jr., U.S. Pat. No. 2,497,418, February 1950, whose rolling hand rest writing device must be in contact with the writing surface, is not a hand held device, and concentrates on persons with total digital impairment or hand paralysis shifting the emphasis to arm and shoulder control to provide the ability to write.

The J. F. Hume, U.S. Pat. No. 1,438,114, December 1922, "Writing Implement" comprising of whole hand palm size sliding ball with embedded pen designed to teach proper penmanship while supporting the hand, and which assumes that normal digital control exists.

The patent of H. G. Eastman, U.S. Pat. No. 78,655, issued June 1868, "Improvement In Pen Holders" employs a unique egg-shaped palm rest coupled with slip-in finger holders for the correct positioning of the pen, but the design does not provide for pressure of the palm to aid in the writing process, nor for non-finger use, or for gripping the instrument other than by conventional methods.

The "Tool Holding Appliance" Winter et al., U.S. Pat. No. 4,606,484, issued Aug. 19, 1986 utilizes a device which is strapped on to the palm of the hand and holds very specifically designed tools and utensils and is intended for persons with limited hand mobility. A more significant invention in this field by Brody, U.S. Pat. No. 4,523,781, issued Jun. 18, 1985 was specifically designed for those persons suffering from arthritis and others having reduced gripping ability. Brody's device, a palm size, barrel-shaped, clam-shell-type instrument holder is meant to be held and manipulated within the palm of the hand, and when a user lacks any digital dexterity, the device can be strapped onto the hand. Brody's design assumes that a normal "palm" or open palm does exist and has limited application for controlled downward pressure other than through the attachable hand strap or gripping of the barrel, and does not make allowances for: more adaptable hand positioning as the individual deformity may require for comfort or for unorthodox use of those parts of the hand such as the "V" joints between fingers; or the palm and inner finger joint only, without the use of the actual fingers; or the use of any two desired fingers however closely or widely spaced; or unbending fingers that may still be usable for downward pressure and control of a writing instrument.

There are other numerous patented writing instrument holders which tie on, strap on, or slip on or through, but such holder each is designed to overcome a specific infirmity or add a degree of ease and comfort. Based on prior art known to this inventor, no hand-held writing instrument holder is available that has the adaptability of my writing instrument holder, or offers the many simultaneous combinations as is needed by the user, the many compound vertical, horizontal, bevelled, rounded, concave, convex or volute surfaces for variable open-finger grasping positions, or degree of control from parts of the finger exerting pressure and manipulation, or the capability of using the palm of the hand in conjunction with an opposing member in an unorthodox manner for holding and guiding a writing instrument or other type of instrument, providing the restoration of writing abilities, even though minimal prehensile ability exists and absolutely unorthodox highly individualized methods are called for and employed.

It is also important to provide an instrument holder for use by persons having normal holding and writing skills which reduces the gripping forces required to manipulate conventional instruments and which reduces the discomfort, fatigue and/or pain encountered in the performance of repeated operations.

SUMMARY OF INVENTION OBJECTS AND ADVANTAGES

An object of my invention is to provide a writing instrument holder designed to lend advantage to those not having full use of their hands and fingers, to offer a constant variety of alternative compound surfaces, and simultaneous combinations and options in applying pressure and control to a writing instrument other than the conventional combined use of the thumb, index and middle finger of the writing hand pressed against an instrument in a tight grip pattern.

Another object is to provide an instrument holder which conforms to the individual's hand and varying methods of applying controlling pressure thereto, however unorthodox, and being accomplished through the design, materials and construction thereof.

Another object of my invention is to provide an everyday readily attainable and personal answer through the use of this invention to temporary writing disabilities such as finger and hand cramps, sprains or fractures in splints or hand casts.

Still another object of the present invention is to provide a holding device which is simple to use, which may be gripped in a variety of different ways and which optimally minimizes the pressing forces typically used to hold and manipulate an instrument.

DETAILED DESCRIPTION OF THE EMBODIMENTS

The illustrations shown in FIGS. 1–13 and 17–19 are of writing instrument holder devices manufactured hand specific, in this case, for the right hand. the preferred construction material is of lightweight semi-rigid plastic, foam, rubber, or composite material exhibiting qualities such as resilience, tear resistance, ability to compress and conform to a variety of instruments of varying shapes inserted into the instrument holder path #1, and have the ability to decompress or spring back to its original shape after repeated uses. The material may be porous to allow for long periods of use without causing finger or hand sweating. Non-porous materials may also be advantageous, because they permit either wet or dry sterilization, and offer greater stain resistance than do porous materials. In addition, the materials should have a tendency to conform, or give slightly under the individual style of applying pressure to, in effect, mold to that person's style of use and their physical finger/hand characteristics. Weight of the device should be such that it is comfortable to hold for extended periods of time, and is not a negative comfort factor in the writing process. The size of the writing instrument holder should be such that it fits into the palm of the hand easily, and is large enough to accept all fingers.

Figure 1:
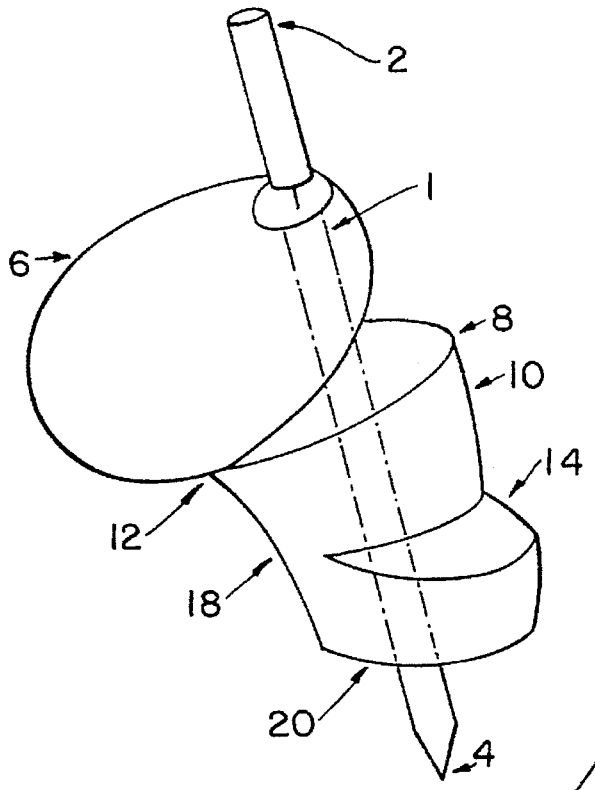
FIG. 1 Right side view of instrument holder
Figure 1A:
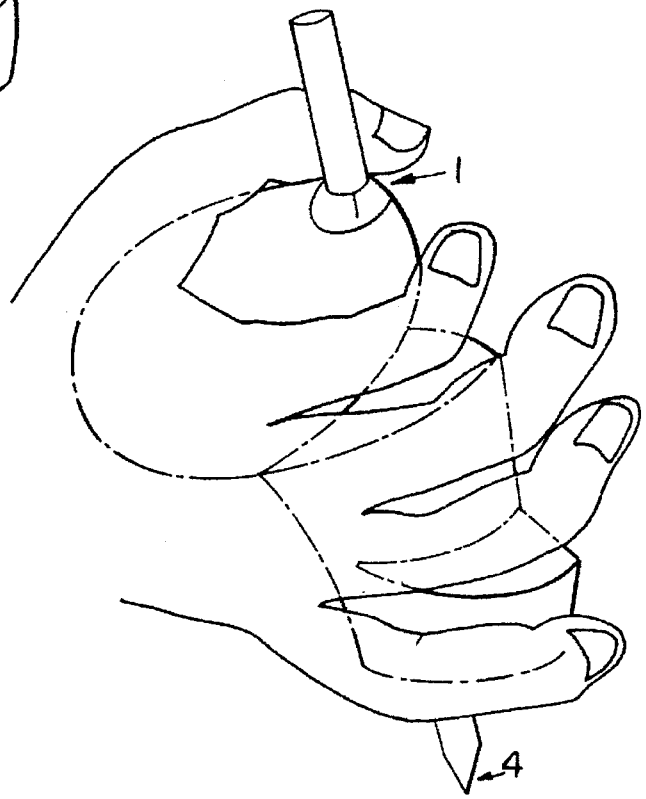
FIG. 1A Instrument holder in use by right handed person indicating hand, palm and finger position options FIG. 2 Front view of instrument holder FIG. 3 Top view of instrument holder FIG. 3A Top view of instrument Holder with hand in position indicating palm rest, and upper and lower finger shelves FIG. 4 Left side of instrument holder FIG. 4A Left side view with hand in position FIG. 4B Left side view, another alternate method of grasping the instrument holder at the concave contoured surface showing that full instrument use can be accomplished using only the pressure applied from the inner thumb and base of the index finger, or webbing between fingers. No actual finger pressure is needed for the use of the instrument.

In FIG. 1, a right hand unit is shown. For greatest utility, offering finger control on one side or the other, the unit must be manufactured hand specific, left or right, but not precluding a double sided unit. All figures shown are for a right hand device. Here the right side view of FIG. 1 will serve to clarify the reason for hand specific design. Starting from the top palm rest #6 to the bottom finger shelf rest #14, there is a decided twist to the right in a spiral staircase-like form. As shown in FIG. 1A, when the palm of the hand is placed over the palm rest #6, the fingers of the right hand will conform or fall naturally into this spiral staircase pattern. Merely grasping or draping fingers, usable or non-usable fingers, over the form will automatically position them on the device for either resting/holding and/or for downward pressure use and control. FIG. 1 shows a standard angle of use. The instrument core 1 is designed to accept a variety of small diameter, relatively smooth instruments ranging from circular to square to flat or to compound shapes, through a combination of the material's resiliency and its ability to conform to varying surfaces. Seen clearly in the top view FIG. 3, the core consists of a small bore hole which expands to accept a round instrument, and two flat cross slits through the length of the instrument which expand to accept flat to square instruments. The bore hole and cross slit width dimensions may vary with the resilience of the material used. The preformed pathways enable the material to expand and conform more easily to the shape of the instrument without straining or tearing. As shown in FIG. 1, the instrument is inserted into the core by pushing the instrument into either the top or bottom of the device which is clearly marked, until the desired length of instrument tip 4 is reached.

Figure 3:
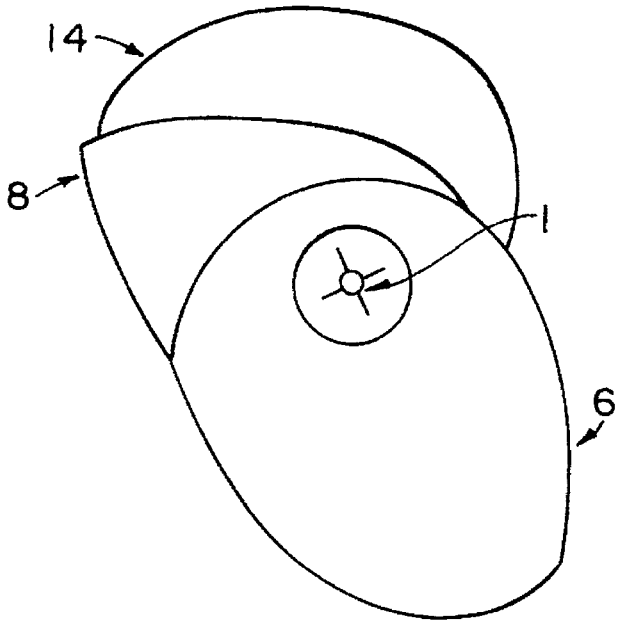
Figure 3A:
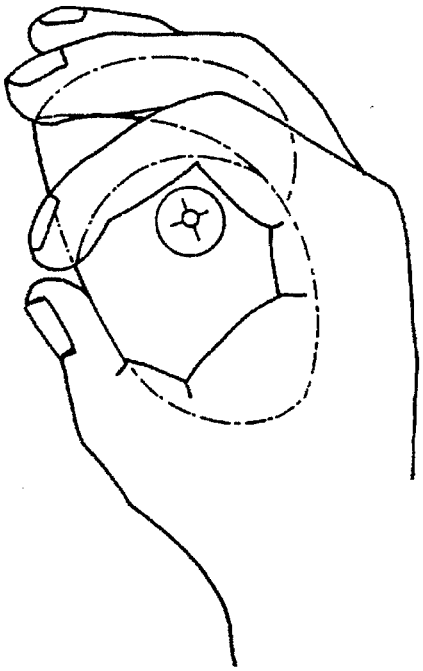

Using this position as an example shown in 1A for writing, the hand is draped over the palm rest. The fingers are unbent or bent slightly to conform to the device are positioned on the upper finger shelf 8 and lower finger shelf rest 14, with the option of placing the small finger also or rest 14 if desired. Depending on the mobility and use of the fingers, the vertical grasp portion 10 may be held for further control. In the top view FIG. 3 the instrument core slit marking 1 can be seen, the oval-shaped palm rest 6 is offset to the right with the finger shelf rests 8 and 14 directly under the palm rest. A normal hand position is illustrated in FIG. 3A with the fingers on the upper and lower shelves. Depending on the dexterity of the fingers and the need to support them, rotating the device slightly counter clockwise toward the straighter side allows the fingers to be supported in a straight unbent position; rotating the device clockwise, the fingers may encircle and grip the device in an open handed grasp.

Figure 2:
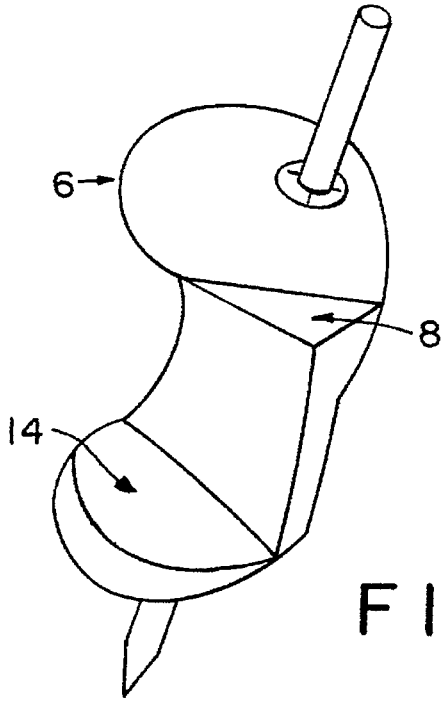

A front view of the device is shown in FIG. 2. Here the oval-shaped palm rest is seen to be offset in the direction for use by a right handed person. The fingers shelves 8 and 14 are spiraled to the right hand, and they are bevelled or sloped downward allowing finger pressure, created naturally by placement of the fingers on the platforms to act as a counterbalance to the palm pressure adding more control in the writing or instrument handling process.

Figure 4:
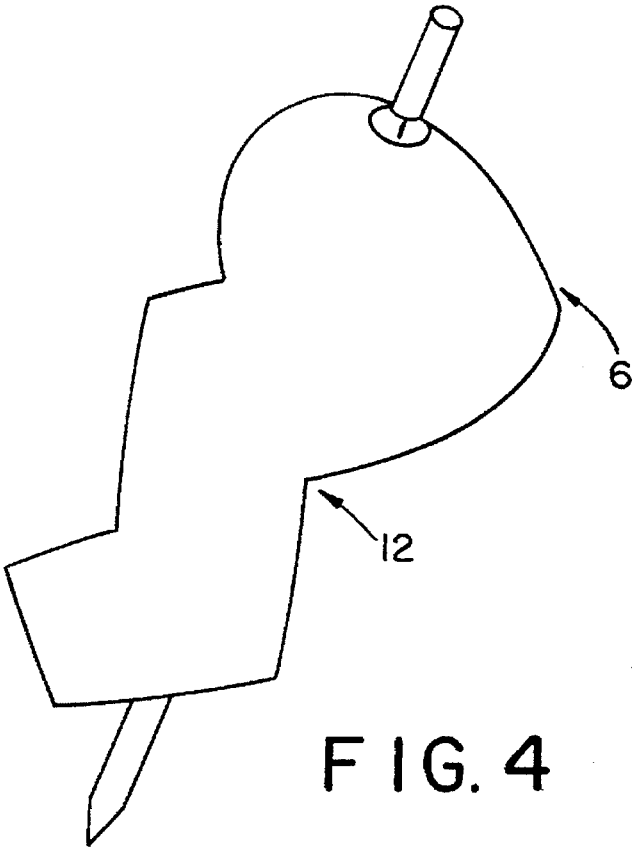
Figure 4A:
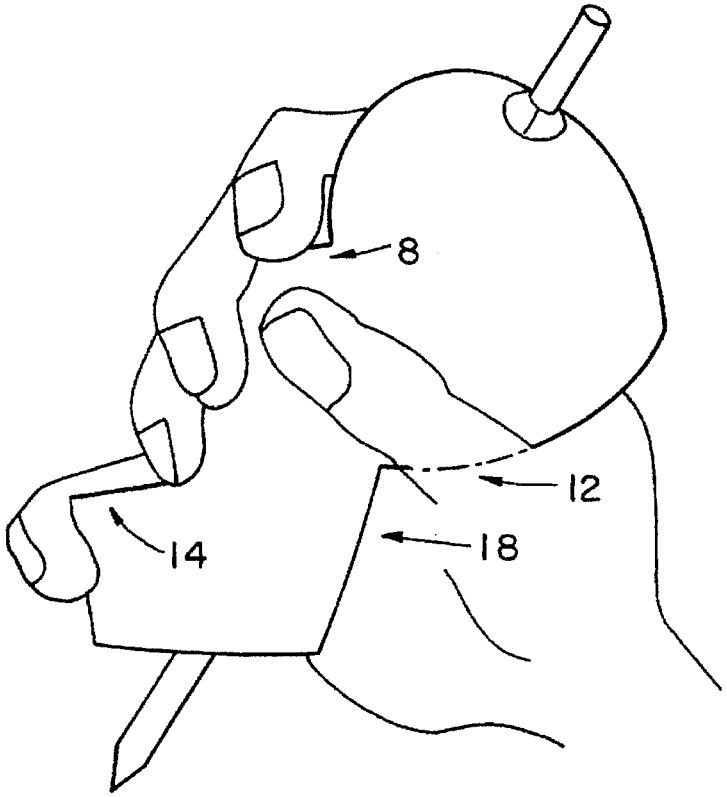

The left-hand view shown in FIG. 4 exposes the underside curvature 12 of the oval-shaped palm rest 6. This area is designated as the upper bevelled detente and serves as an upper hand stop limit keeping the hand from slipping upward when used as illustrated in FIG. 4A, the thumb is shown under the palm rest, finger tips exert pressure at rests 8 and 14, while the upper detente 12 and back 18, provide counterbalance and control.

Figure 4B:
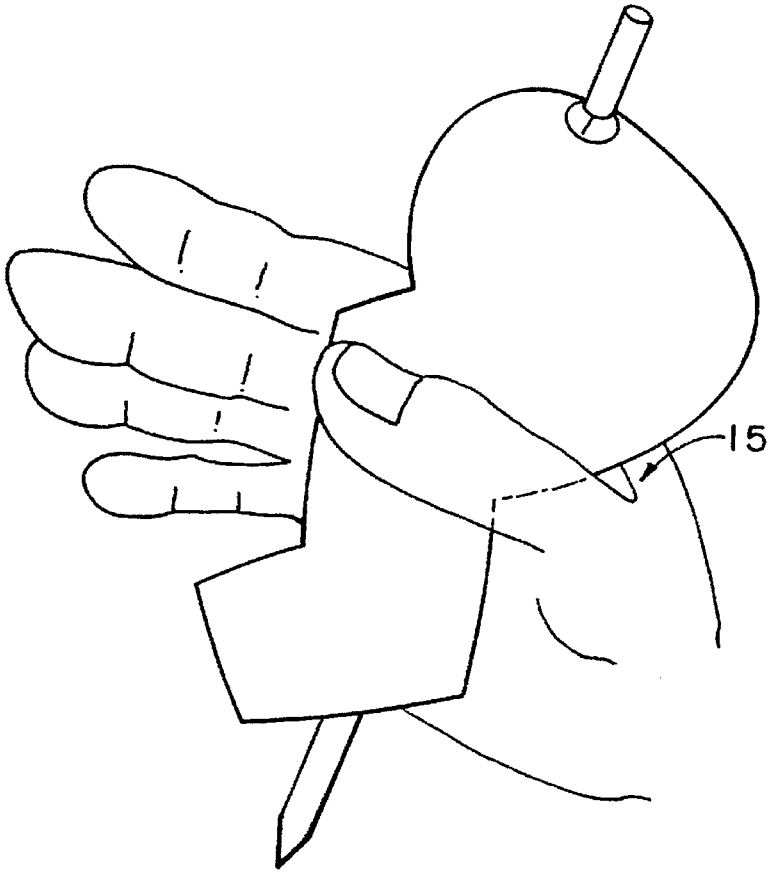
Figure 5:
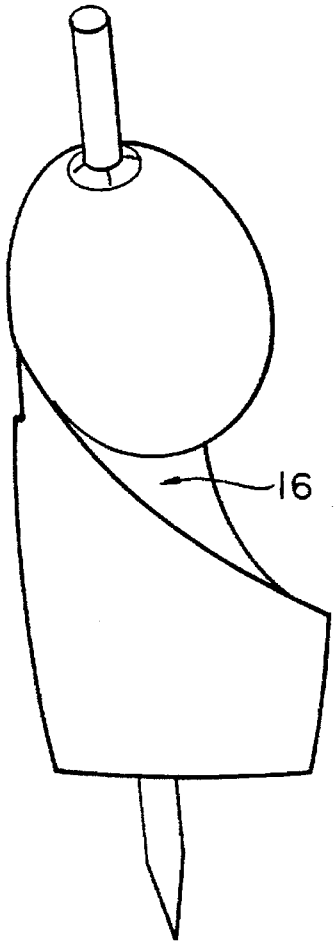
FIG. 5 Back view of Instrument holder

In an example of use where deformities may cause clenched or tightened fingers not able to close on a writing instrument, or a hand set in a cast with limited use of fingers, either of which might allow only the use of the "v" between the thumb and index finger but not the palm of the hand, the device may be used as in FIG. 4B with the thumb joint low on the left side of the device. The pressure pushing inward naturally forces the device into the "V" 15 of the hand between finger joints. As this occurs, the webbing between fingers conforms to the concave side surface 16, FIG. 5, and further secures the device adding control of the writing instrument. The inner curve of the "V" and the inner joint of the index finger follows the concave contour, and in combination with the upper detente 12, the device is cradled securely without additional controls/fingers needed.

Figure 6:
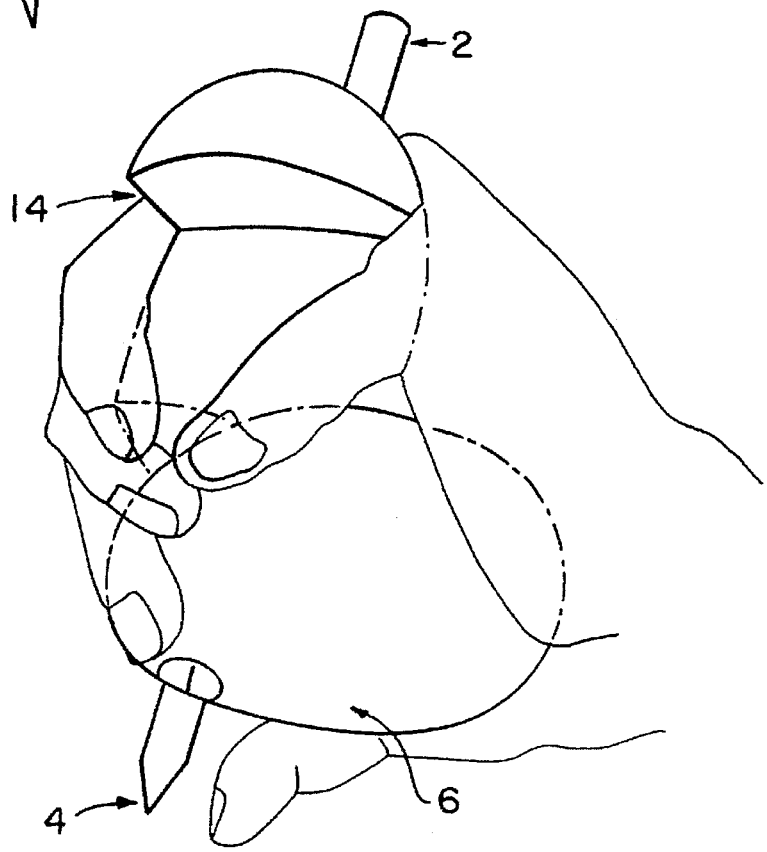
FIG. 6 Reverse view, alternate method of grasping instrument holder. Holder and writing instrument are shown in an upside down position, the writing instrument reversed. In this position downward pressure of the palm of the hand is used to accomplish control of the instrument in conjunction with wrist or finger guidance, or minimum pressure from the inner thumb and base of the index finger. No actual finger pressure is needed for the use of the instrument in this position.

In an almost identical situation, with the fingers clenched, or with the fingers in an open position but with little gripping ability, and where the palm of the hand is usable and desirable, FIG. 6 shows that the writing instrument holder may be held reversed, upside down with the palm rest 6 in the downward position. The writing instrument 2 to 4 is removed and reversed also. The object here again is to grasp the device in the "V" or webbing of the hand between finger joints. In this configuration the aft underside of 6 becomes the palm rest surface and is now a larger circumference object easier to grasp and is another method of control. The concave side 16 becomes an aid in guiding and nesting the holder between the webbing or "V" of the hand. Control of the device in this position is accomplished by grasping of a larger object the palm rest 6, which might be desirable for those persons with limited finger joint mobility and using the "V" between finger joints in grasping the concave surface 16 and using downward pressure on the palm rest.

Because of the ergonomic simplicity inherent in the design numerous combinations with variations of pressure control and push-pull manipulation are possible with the multiple planes and control surfaces provided to allow for maximum flexibility for individual need.

Figure 7:
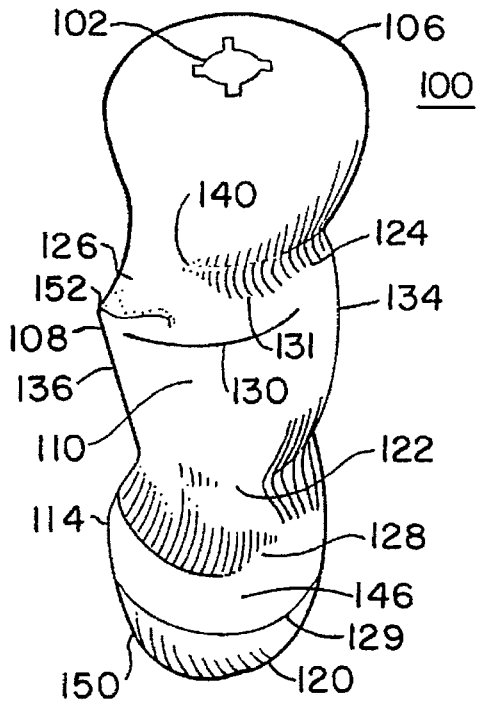
FIG. 7 is a front elevation view of a second exemplary embodiment of the invention.

FIG. 7 through FIG. 10 show a second exemplary embodiment of the invention. The embodiment of FIG. 7 is formed of a suitable material as described above with reference to the embodiment of FIG. 1, and is similar in overall size. The embodiment of FIG. 7 has more round contours and no sharp edges. As described below, the additional round contours allow the user to develop a more personalized method of grasping the device.

Although body 100 shown in FIG. 7 is hand specific for a right handed person, it is understood that a left hand version is formed by constructing a body which is the mirror image of body 100. All references to the right side and left side of body 100 are reversed for the left hand model. Also note that the left and right directions are defined so that the left side 134 of body 100 appears on the left in FIG. 9 and on the right in FIG. 7. The right side 136 of body 100 appears on the right side in FIG. 9 and on the left side in FIG. 7.

Figure 10:
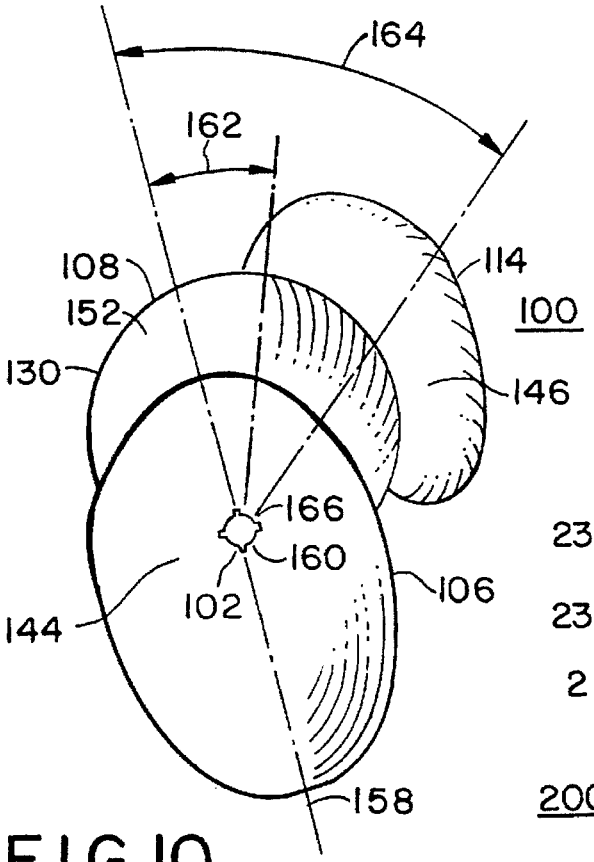
FIG. 10 is a plan view of the device shown in FIG. 7.

The device is formed as a single body 100 having a top portion 106, a bottom portion 120 and a bore 102 (as shown in FIG. 10) extending from the top 106 to the bottom portion 120. The bore 102 is adapted to receive an instrument. The bore is generally square in cross section, with each side approximately 0.75 centimeters long. At each corner of the square bore 102 there is a slot 166 approximately 0.15 centimeters. At the top portion 106 of the body 100, the size of bore 102 is reduced to approximately 0.60 centimeters on each side to snugly grip a variety of hand held instruments. The two slots through the length of the instrument expand to accept instruments ranging in shape from flat to square and round. The bore hole and slot width dimensions may vary in accordance with the resilience of the material used. The slots enable the material to expand and conform more easily to the shape of the instrument without straining or tearing. Other cross sections may also be used for bore 102. For example, bore 102 may be round, and may have a saw-toothed cross section.

Body 100 has three portions: an ovate top portion 106, a bottom portion 120 having a lower finger shelf 114, and an upper finger shelf 108 between top portion 106 and lower finger shelf 114.

Figure 7A:
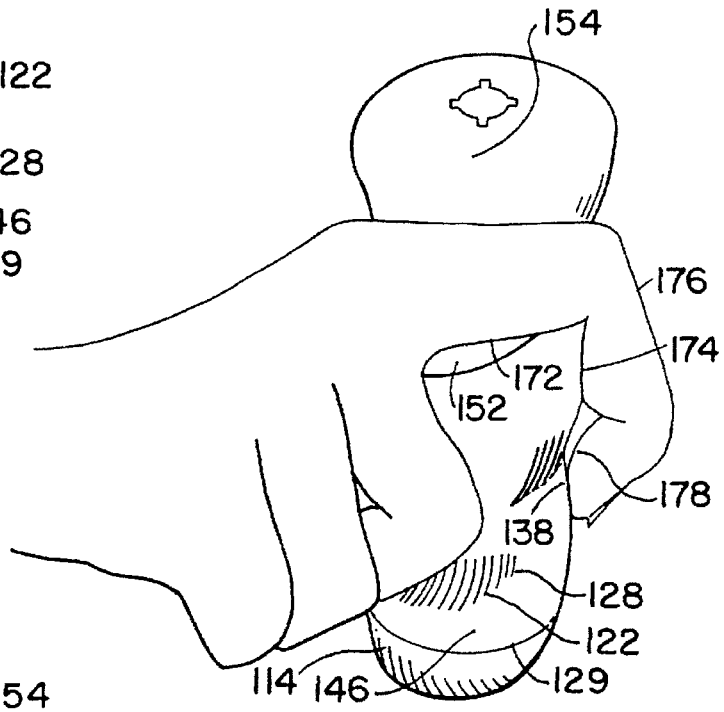
FIG. 7*a* shows a hand gripping the device shown in FIG. 7.
Figure 8:
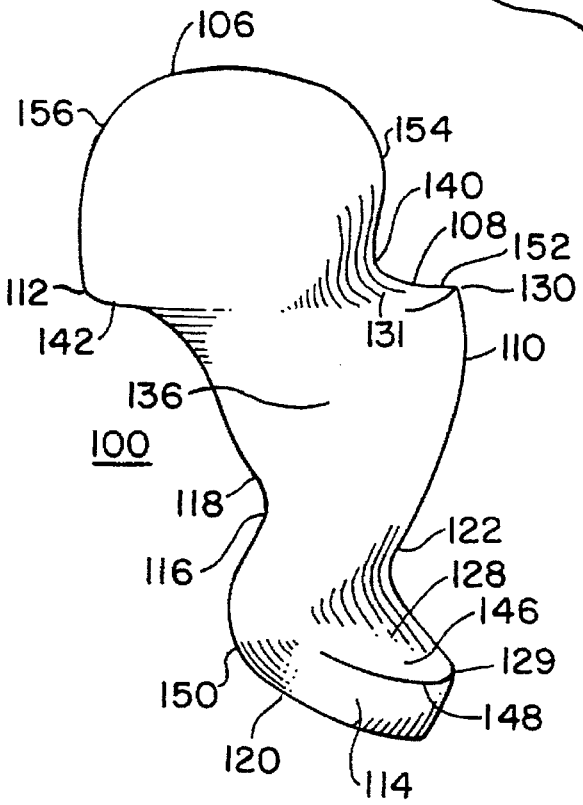
FIG. 8 is a side elevation view of the device shown in FIG. 7.

As is shown in FIG. 7 and FIG. 8, lower finger shelf 114 extends radially and downwardly from the bottom portion 120 of body 100, forming a lower finger shelf upper surface 146. Although many different parts of the hand may comfortably rest on lower finger shelf upper surface 146, surface 146 is sized to receive the dorsal surface of the terminal phalanx (the end section) of the middle finger of a user's hand. This hand position is shown in FIG. 7*a*. The curvature of surface 146 is gentle enough to allow the finger to rest on surface 146 without squeezing the finger. Furthermore, surface 146 does not precisely match the contour of the terminal phalanx, so that other hand surfaces may rest on lower finger shelf. In particular, the joint between the middle phalanx and the terminal phalanx of the middle finger may be comfortably placed in surface 146. As the middle finger rests on surface 146, the weight of the hand applied through the middle finger provides sufficient pressure for writing and drawing.

The lower finger shelf upper surface 146 may extend from body 100 approximately 1.8 centimeters from inner edge 128 of surface 146 to outer edge 129 of surface 146 (The inner edge 128 is the locus of points at which the relatively flat surface 146 and the saddle shaped front surface 122 meet). Although this dimension may be varied, surface 146 should extend from its inner edge 128 at the front surface 122 of body 100 by a distance sufficient to extend from the lateral surface of a user's middle finger to the median of the dorsal surface of the user's middle finger. This ensures that the dorsal surface of the user's middle finger rests on surface 146 without slipping off.

Surface 146 wraps around the right side 136 of body 100. Thus, with the hand grasping body 100 in an alternate position (similar to the hand position shown in FIG. 1*a*), surface 146 supports the lateral surface of the fourth finger. A user may also choose to rest the lateral surface of the fifth finger on surface 146 (hand position not shown). Or if body 100 is held upside down (using the hand position shown in FIG. 6), surface 146 rests on the lateral surface of the index finger.

Body 100 has a front surface 122 in the form of a saddle between finger shelf 114 and top portion 106. (Mathematically, a saddle is formed in a surface whose partial derivatives at a point are zero with respect to two orthogonal axes. The partial derivative is elsewhere positive with respect to the direction of the first axis; and the partial derivative is elsewhere negative with respect to the direction of the second axis). Front surface 122 merges with finger shelf upper surface 146 at the inner edge 128 of surface 146. Front surface 128 is sized to receive the lateral surface of the terminal phalanx of the middle finger when the dorsal surface of the terminal phalanx rests on surface 146 (as shown in FIG. 7*a*). The saddle shape of front surface 122 provides a comfortable gripping surface that assists in lifting body 100 (and the attached hand held instrument).

Advantageously, the size of front surface 122 is also useful for receiving the anterior surface of the fourth finger if the lateral surface of the fourth finger rests on surface 146 (similar to the hand position shown in FIG. 1*a*). Front surface 122 also receives the anterior surface of the fifth finger, if the lateral surface of the fifth finger rests on surface 146 (position not shown). Of, if body 100 is held upside down with the hand in the position shown in FIG. 6, the anterior surface of the index finger wraps around front surface 122.

The bottom surface 150 of lower finger shelf 114 may be round and generally convex, with a radius of curvature, of approximately 0.6 to 0.7 centimeters. Bottom surface 150 of lower finger shelf 114 extends to the bottom surface 120 of body 100, which may be flat and elliptical in shape. Using round surface 150, a user may rest body 100 on a surface at a variety of angles, or grasp the bottom surface 150 with the inside of the palm. A variation of this embodiment of the invention (not shown) includes a substantially flat lower finger shelf bottom surface 150, forming the bottom surface of body 100.

The middle portion of body 100 forms upper finger shelf 108. Upper finger shelf 108 has an upper surface 152, a vertical surface 110, and a back surface 118. The upper surface 152 of upper finger shelf 108 has an outer edge 130, formed at the intersection of upper surface 152 and vertical surface 110.

Figure 9:
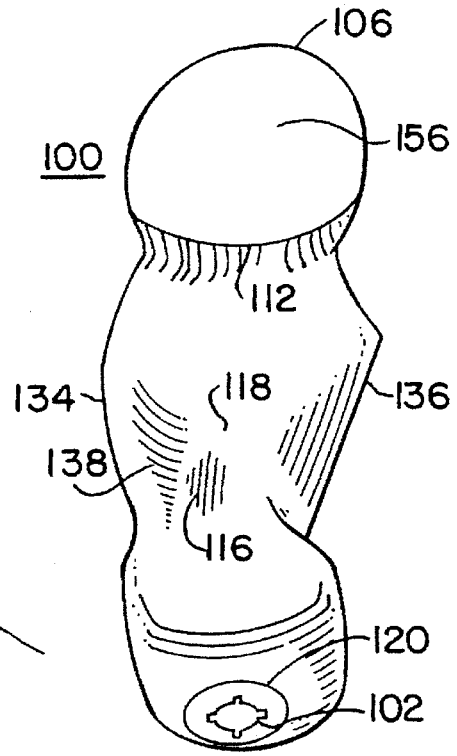
FIG. 9 is a rear elevation view of the device shown in FIG. 7.

As shown in FIG. 7, the left side 134 (note that left side 134 appears on the left in FIG. 9 and on the right in FIG. 7) of upper surface 152 is closer to the top portion 106 of body 100 than is the right side 136 (note that right side 136 appears on the right side in FIG. 9 and on the left side in FIG. 7). Surface 152 extends upwardly towards the left side 134. When body 100 is held in the manner shown in FIG. 7*a*, surface 152 provides support for the anterior surface of the proximal phalanx of the index finger.

Vertical surface 110 is generally convex in shape, and has a relatively large radius of curvature which may be approximately 5.0 centimeters. Vertical surface 110 extends between front surface 122 and the outer edge 130 of the upper surface 152 of upper finger shelf 108. The bottom of vertical surface 110 merges into saddle shaped front surface 122. Thus vertical surface 110 extends outwardly from front surface 122 to outer edge 130 of upper surface 152 of upper finger shelf 108.

Vertical surface 110 is adapted to receive the anterior surfaces of the middle finger and fourth finger (proximal, middle and terminal phalanges) when body 100 is held in a position similar to the hand position shown in FIG. 1*a*. Vertical surface 110 also is adapted to receive the anterior surfaces of the index finger and middle finger when body 100 is held upside down, in a position similar to the hand position shown in FIG. 6.

Convex vertical surface 110 wraps around the right side 136 of body 100. On the right side 136, vertical surface 110 extends from upper finger shelf upper surface 152 to lower finger shelf upper surface 146. At its right side 136, vertical surface 110 extends outwardly from the portion of surface 122 which wraps around the right side 136 of body 100, to outer edge 130 of upper surface 152 of upper finger shelf 108.

As shown in FIG. 8 and FIG. 9, the back surface 118 of the middle portion of body 100 is generally convex on the middle portion of body 100. There is a concave depression 116 at the bottom of back surface 118, where the middle and bottom portions of body 100 meet. Depression 116 of back surface 118 is adapted to receive the anterior side of the first finger (the thumb) of the hand, when body 100 is held in the position shown in FIG. 7*a*. Depending on the user's preferred hand position, depression 116 may receive the proximal phalanx of the first finger, the terminal phalanx, or the joint therebetween.

Referring now to FIG. 9, the back surface 118 of body 100 is shown. On the left side 134 of body 100 is a concave depression 138. Depression 138 is adapted to receive the anterior side of the terminal phalanx of the index finger of the hand when body 100 is held in the position shown in FIG. 7*a*.

As shown in FIG. 7, FIG. 8 and FIG. 9, the top portion 106 of body 100 is an ovate or egg-shaped portion 106 located above upper finger shelf 108. Ovate top portion 106 forms a palm rest similar to the palm rest 6 shown in the embodiment of FIG. 1. The surface of ovate portion 106 is generally convex. The smaller end 154 of ovate portion 106 is at the front of body 100. The larger end 156 of ovate portion 106 is at the back of body 100. Ovate portion 106 has a longitudinal axis 158 (shown in FIG. 10), which extends from smaller end 154 to larger end 156.

The main difference between palm rest 6 (shown in FIG. 1) and ovate top portion 106 is that ovate portion 106 has at its bottom smoothly curved surfaces which merge seamlessly with the contours of upper finger shelf 108. In particular, the upper surface 152 of upper finger shelf 108 has an inner surface 140 which curves upwardly to join ovate portion 106. At the front of body 100, inner surface 140 is in the form of a saddle, similar to the shape of front surface 122. Inner surface 140 wraps around the right side 136 and the left side 134 of body 100. As shown in FIG. 7 and FIG. 9, the right and left sides 134 and 136 each curve upwardly to join and merge with ovate portion 106. Ovate portion 106 has a curved undersurface 142 which merges with back surface 118 of body 100.

Convex back surface 156 of ovate portion 106 extends to meet undersurface 142 and to form a detente 112 between convex back surface 156 of said ovate portion and underside 142. While body 100 is held in the "V" between the thumb and index finger (similar to the hand position shown in FIG. 4*b*), detente 112 prevents body 100 from slipping out of the hand during use.

FIG. 10 shows the top portion 106 of body 100. Body 100 is volute, similar to the embodiment shown in FIG. 1. As shown in FIG. 10, ovate portion 106, upper finger shelf 108 and lower finger shelf 114 form a spiral when viewed from above. As shown in FIG. 7, upper surfaces 152 and 146 of respective upper finger shelf 108 and lower finger shelf 114 follow a helical path around the periphery of body 100. Bore 102 has a bore axis 160. Longitudinal axis 158 of ovate portion 106 is substantially normal to bore axis 160. Upper finger shelf 108 is offset by a first angle 162 from longitudinal axis 158. Lower finger shelf 114 is offset by a second angle 164 from longitudinal axis 158. Second angle 164 is greater than first angle 162.

The embodiment of the invention shown in FIG. 7 through FIG. 10 may be grasped in any of the positions illustrated and discussed above with respect to FIG. 1 through FIG. 6. Furthermore, the added contours in body 100 provide the user with a greater range of possible hand and finger positions. The potential for each user to select an individual position best suited to his or her hand shape, physiological condition and intended application is enhanced.

Figure 8A:
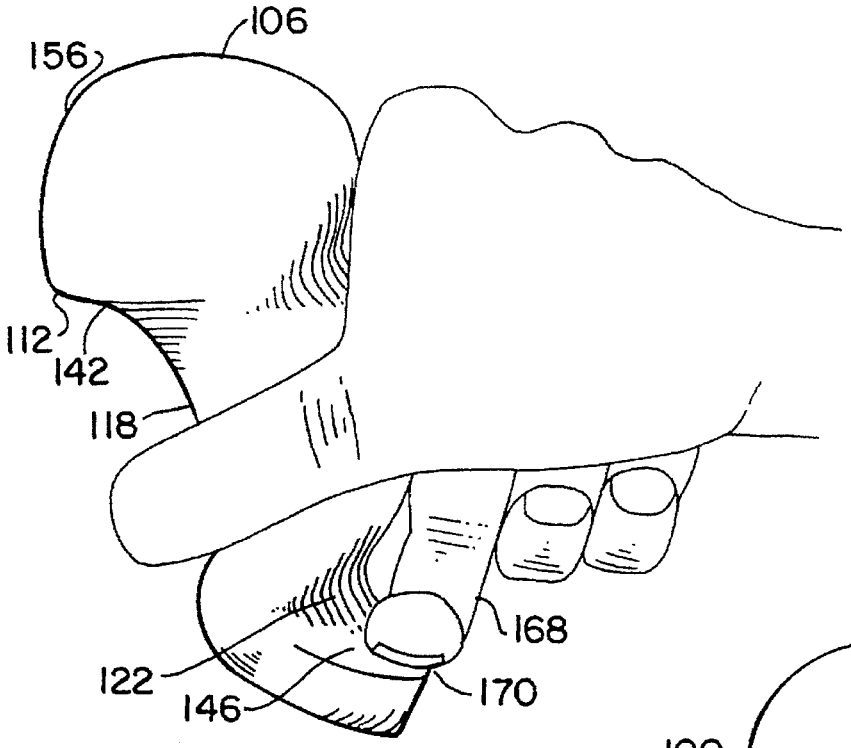
FIG. 8*a* shows a hand gripping the device shown in FIG. 8.
Figure 9A:
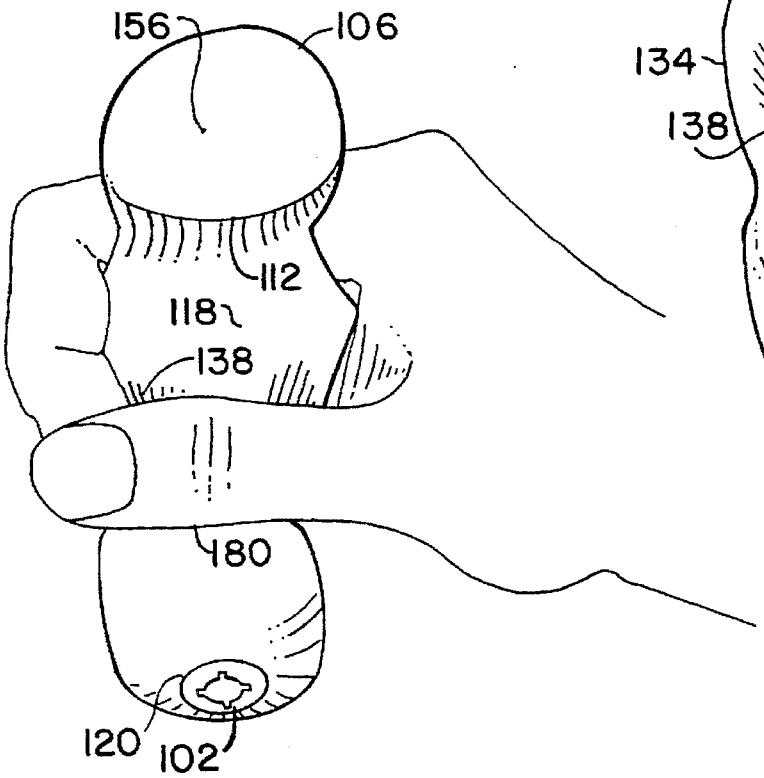
FIG. 9*a* shows a hand gripping the device shown in FIG. 9.

For example, FIGS. 7*a*, 8*a* and 9*a* show a hand draped around body 100 in a novel position. Referring to FIG. 7*a*, the index finger is draped over upper finger shelf 108, so that the anterior surface 172 of the proximal phalanx of the index finger 176 rests on surface 152 of upper finger shelf 108. The anterior surface 174 of the middle phalanx and the anterior surface 178 of the terminal phalanx of the index finger 176 rest on the left side 134 of body 100. Referring now to FIG. 7*a* and FIG. 9*a*, the anterior surface 178 of the terminal phalanx of index finger 176 is received by concave depression 138 on the left side 134. As shown in FIG. 8*a*, the dorsal surface 170 of the terminal phalanx of the middle finger 168 is received by surface 146 of lower finger shelf 114. As shown in FIG. 9*a*, the anterior surface of the first finger (thumb) 180 wraps around the back surface 118 and is received by the concave depression 116 shown in FIG. 9. This hand position is particularly advantageous for individuals with the physical infirmities discussed above as well as carpal tunnel syndrome, and for those who may not suffer from any handicap or physical infirmity, but who tend to develop writer's cramp. These individual may hold a pen or pencil for longer periods with reduced pain in this manner.

It is understood by those skilled in the art that the embodiment of the invention shown in FIG. 7 through FIG. 10 may be customized for users who may not require all of the gripping surfaces of body 100. FIG. 11*a* shows two planes 182 and 184 passing through body 100. Individuals who only intend to hold the device in the position shown in FIG. 7*a*, FIG. 8*a* and FIG. 9A, do not use the surfaces of body 100 above plane 182, or the surfaces below plane 184. The same is true for individuals who only intend to hold the device using the "V" between two of the fingers.

Figure 11:
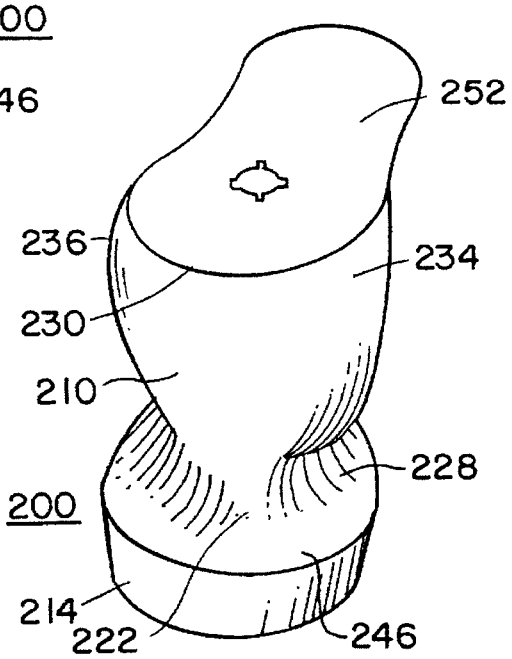
FIG. 11 is a front elevation view of a third exemplary embodiment of the invention.
Figure 11A:
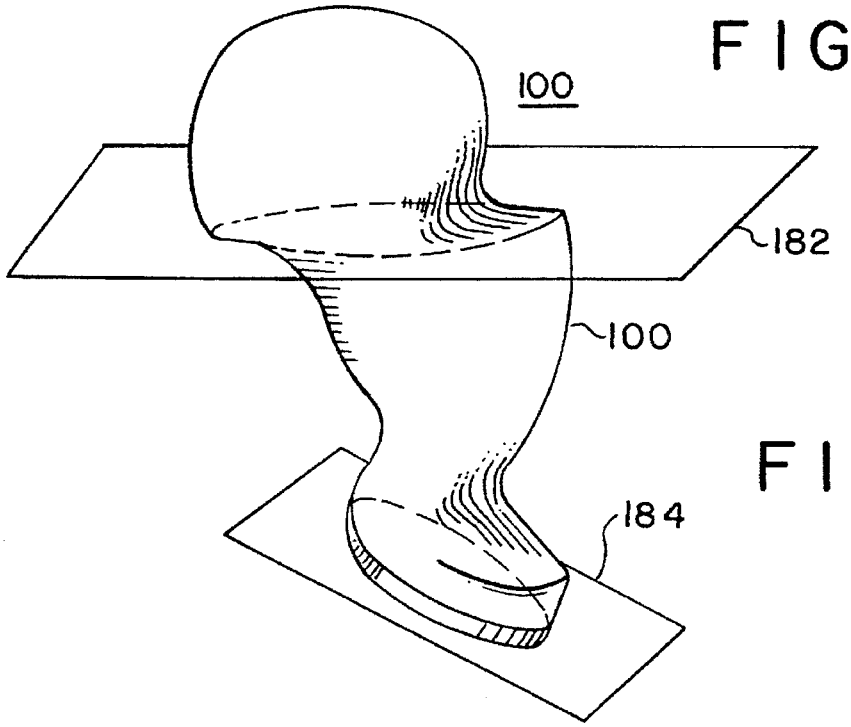
FIG. 11*a* is a side elevation view of a device as shown in FIG. 7, modified to form the device shown in FIG. 11.
Figure 12:
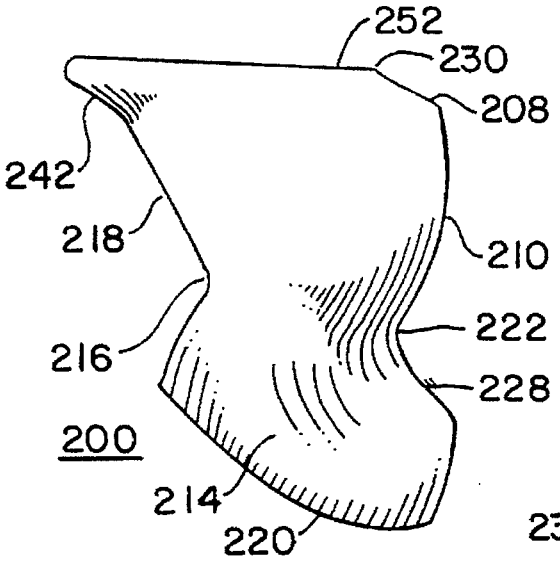
FIG. 12 is a side elevation view of the device shown in FIG. 11.
Figure 13:
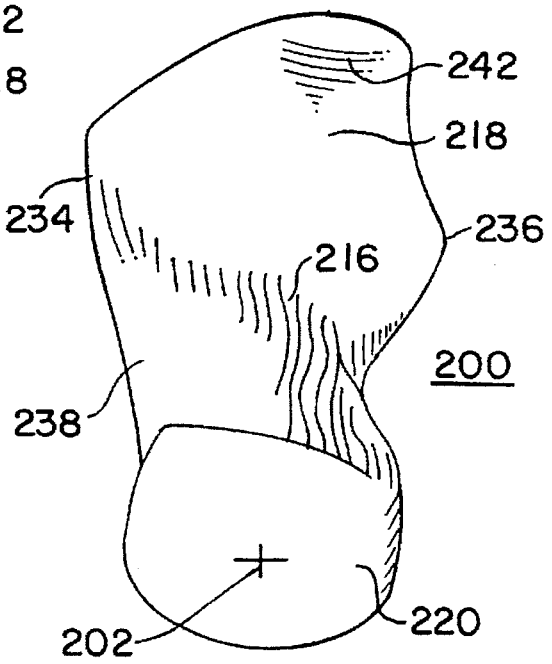
FIG. 13 is a rear elevation view of the device shown in FIG. 11.

FIG. 11 through FIG. 13 show a further exemplary embodiment of the invention. Body 200 is similar to body 100 shown in FIG. 11*a*, with the surfaces above plane 182 and the surfaces below plane 184 removed. For convenience, features which are the same in both body 100 (FIG. 7) and body 200 (FIG. 11) have reference numerals with the same last two digits; only the most significant digit of the reference numeral is changed from 1 to 2.

The materials used in body 200 are the same as those used in body 100. Body 200 is particularly suitable for individuals who wish to hold the instrument gripping device in the hand position shown in FIG. 7A, FIG. 8*a*, and FIG. 9*a*. Upper surface 252 of upper finger shelf 208 is substantially flat, and may be inclined slightly to be higher on the left side of body 200 than on the right side. The increased area of upper surface 252 (relative to the upper surface 152 in the embodiment of FIG. 7) provides more room to support the anterior surface of the proximal phalanx of the index finger, as well as a portion of the palm. The flat bottom surface 220 allows placement of the hand closer to the writing surface than is possible when body 100 is used.

The remaining surface features of body 200 are the same as described above with reference to FIG. 7, FIG. 8, and FIG. 9. In particular, lower finger shelf 214, inner edge 228, front surface 222, concave depression 238, concave vertical surface 210, back 218, concave depression 216, underside 242, and outer edge 230 are all similar to respective features 114, 128, 122, 138, 110, 118, 116, 142, and 130 as shown in FIG. 7 through FIG. 9. This embodiment of the invention may be more attractive to some users because, even though the features common to bodies 100 and 200 are the same size, the overall length of body 200 (approximately 5 centimeters) is about half the overall length of body 100 (approximately 10 centimeters). This makes body 200 easy to transport in a pocket or purse.

Body 200 may also be used effectively in a number of other hand gripping positions, such as in the "V" between a pair of fingers. Just as the flattened bottom surface 220 allows the hand to be positioned closer to the writing surface than when body 100 is used, if body 200 is inverted, the flat upper surface 252 allows the hand to be placed closer to the writing surface.

Figure 14:
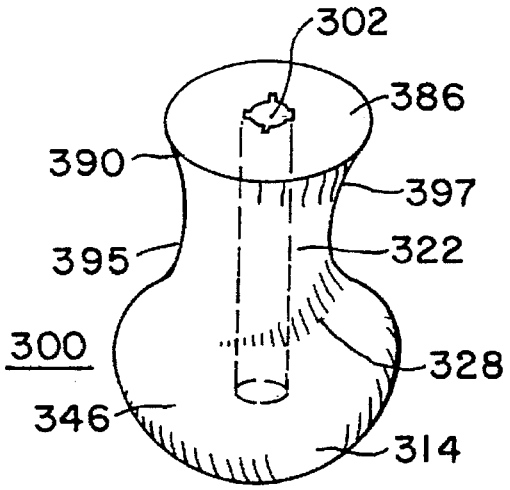
FIG. 14 is a front elevation view of a fourth exemplary embodiment of the invention.
Figure 15:
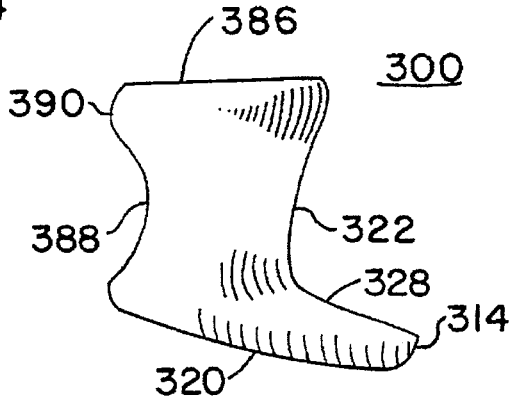
FIG. 15 is a side elevation view of the device shown in FIG. 14.
Figure 16:
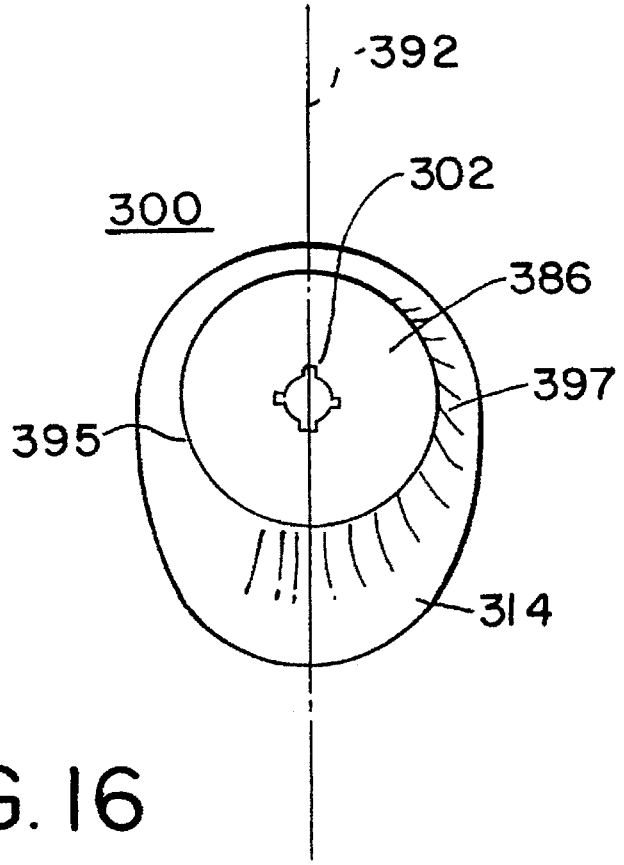
FIG. 16 is a plan view of the device shown in FIG. 14.

FIG. 14 through FIG. 16 show a further exemplary embodiment of the invention. Unlike the embodiments of FIG. 1, FIG. 7, and FIG. 11, body 300, as shown in FIG. 14 through FIG. 16, is not hand specific, As shown in FIG. 16, there is an axis of symmetry 392. Body 300 may be more desirable for use by ambidextrous individuals, and by those who prefer an even more compact size than body 200 shown in FIG. 11. Body 300 is shorter, measuring about 3.5 centimeters from bottom surface 320 to top surface 386. Nonetheless, body 300 still features important aspects of the invention, as explained below.

Figure 15A:
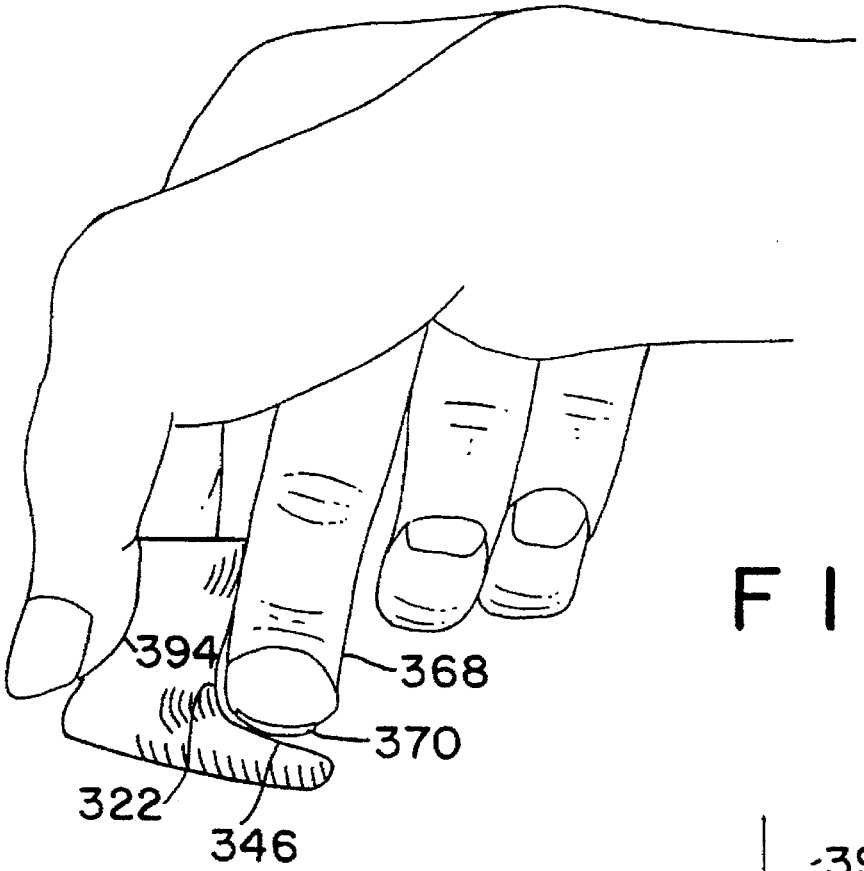
FIG. 15*a* shows a hand holding the device shown in FIG. 15.

Referring to FIGS. 14 and 15*a*, body 300 has a top portion 386, a bottom portion 320 and a bore 302 extending from top portion 386 to bottom portion 320. Bore 302 is similar to bore 102 discussed above with reference to FIG. 7, and is adapted to receive an instrument.

Body 300 has a finger shelf 314 extending radially outwardly and downwardly from bottom portion 320 of body 300, forming a finger shelf upper surface 346 sized to receive the dorsal surface 370 of the terminal phalanx of the middle finger 368 of the hand.

Body 300 has a front surface 322 in the form of a saddle between finger shelf 314 and top portion 386, with front surface 322 extending to and merging with finger shelf upper surface 346. Front surface 322 is sized to receive a lateral surface of the terminal phalanx of the middle finger 368.

Finger shelf upper surface 346 extends from front surface 322 of body 300 by a distance sufficient to extend from the lateral surface to the median of the dorsal surface 370 of the terminal phalanx. In the exemplary embodiment, finger shelf 346 is extended even further, sufficient to extend out by the full width of the middle finger, approximately 1.4 to 1.5 centimeters from the inner edge 328 of surface 346. The extended length provides extra support for the middle finger, and allows the hand to transmit more force with the middle finger easily.

Finger shelf 314 extends approximately three quarters of the way around body 300, as shown in FIG. 16. Again, this allows use of a single device by either hand, still providing a surface 346 to receive the dorsal surface of the middle finger terminal phalanx.

Unlike the embodiments of FIG. 1, FIG. 7 and FIG. 11, the saddle shaped front surface 322 of body 300 wraps around body 300; merging with a back saddle surface 388. A horizontal cross section (not shown), perpendicular to bore 302, would be substantially circular. The anterior surface 394 of the terminal phalanx of the first finger is received by the back saddle surface 388. The anterior surface of the terminal phalanx of the index finger (not shown) is received by the saddle shaped surface on the left or right side of body 300. The symmetrical aspect of saddle shaped front surface 322 makes body 300 useful by right handed, left handed and ambidextrous individuals. There are no concave depressions unique to the left, right, front or back sides of body 300.

Another difference between body 300 and the embodiments of FIG. 1, FIG. 7 and FIG. 11 is that body 300 does not include the upper finger shelf. The anterior surface of the index finger does not rest on the top portion 386 of body 300. Body 300 is gripped only by the terminal phalanges of the first, second and third fingers. Unlike the conventional grip of an instrument (i.e., the grip used for an instrument without a holder) in which the lateral surface of the middle finger is used to hold the instrument and apply pressure, body 300 provides means to apply pressure to the instrument using the dorsal surface of the middle finger. This grip is common with the other embodiments of the invention described herein. The top portion 386 of body 300 has a greater diameter than the saddle shaped surfaces 322, 388, 395, and 397. The larger top portion assists in preventing body 300 from slipping out of the user's hand.

Figure 16A:
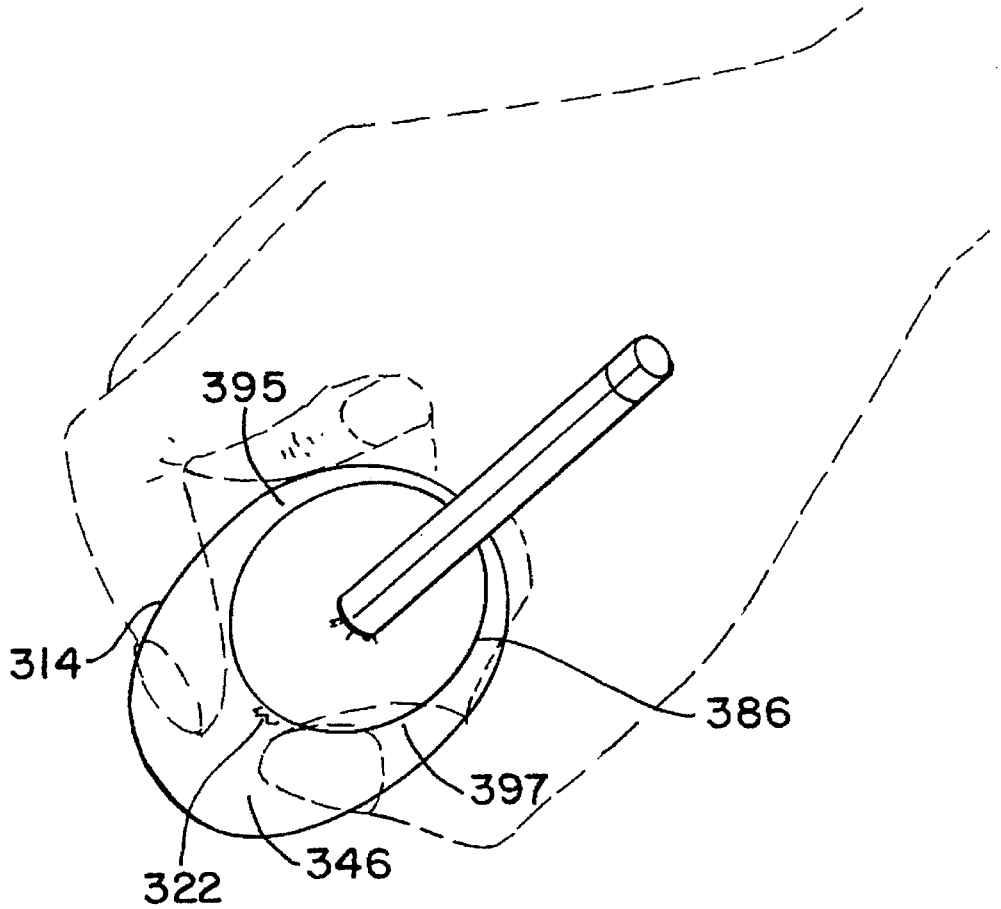
FIG. 16*a* shows a hand holding the device shown in FIG. 16.

FIG. 16*a* shows a different hand position which may be used to grip body 300. In this position, body 300 is rotated about bore 302 by an angle of about 90 degrees from the position shown in FIG. 15*a*. This position provides a slightly different writing angle, and allows the index finger to rest on the extended portion of finger shelf 314. The dorsal surface of the terminal phalanx of the middle finger rests on the portion of finger shelf upper surface 346 on the side 395 of body 300. It will be understood by one skilled in the art that body 300 may be rotated to any position in the 90 degree range between that shown in FIG. 15*a* and that shown in FIG. 16*a* to suit the individual user's style.

Figure 17:
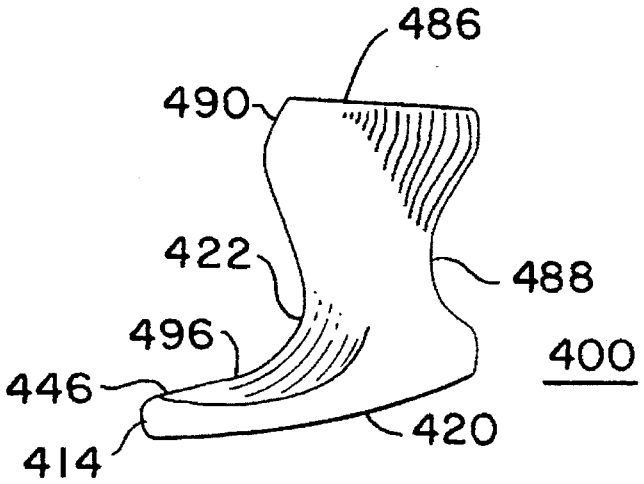
FIG. 17 is a side elevation view of a fifth exemplary embodiment of the invention.
Figure 17A:
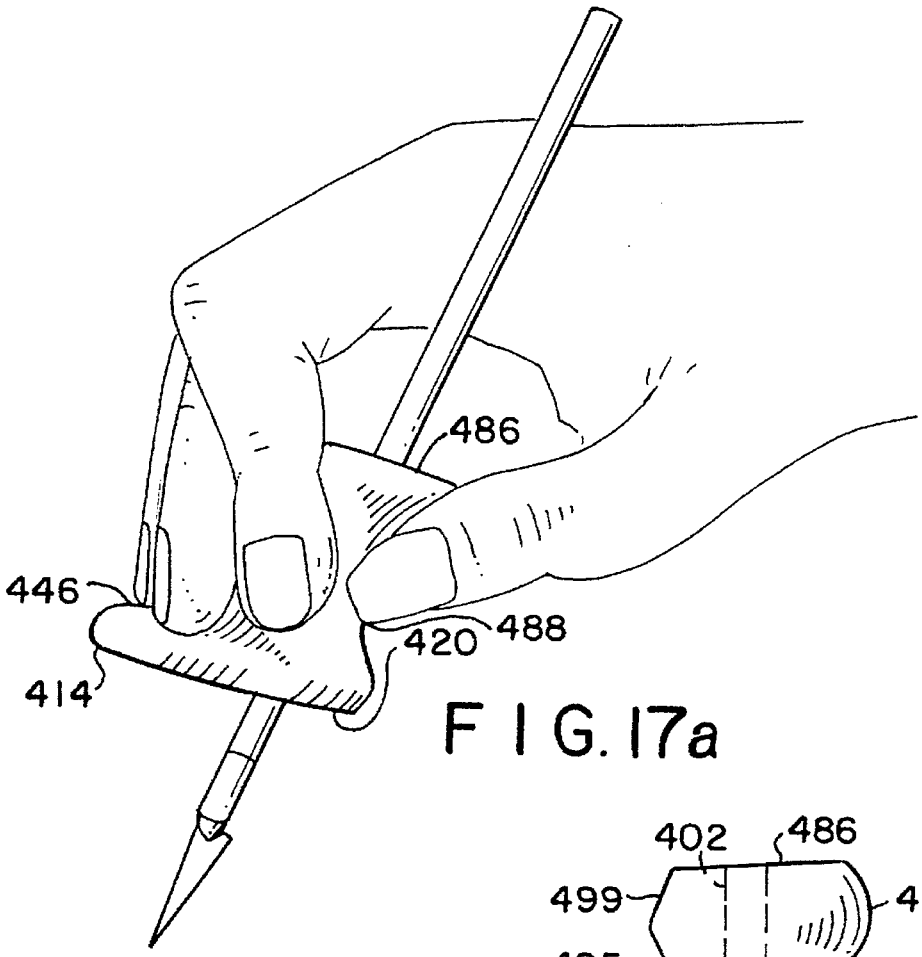
FIG. 17*a* shows a hand holding the device shown in FIG. 17.

FIG. 17 through FIG. 20 show another embodiment of the invention. Body 400, shown in FIG. 17, is similar to the embodiment of FIG. 14, except that body 400 is hand specific, and is made for right handed individuals. The overall size of body 400 is similar to that of the embodiment of FIG. 14. Like body 300 (shown in FIG. 14) body 400 has a top portion 486 which has a greater diameter than the middle portion formed by surfaces 422, 488, 495, and 497. Top portion 486 assists in preventing body 400 from slipping downward or dropping. It is understood that reversal of all surface locations results in a left hand model. Although the right and left handed models are geared towards typical right and left handed users, respectively, an individual right handed user may prefer the left handed model, and a left handed user may prefer the right handed model.

Body 400 has a top portion 486, a bottom portion 420 and a bore 402 extending from top portion 486 to bottom portion 420. Bore 402 is similar to bore 102 discussed above with reference to FIG. 7, and is adapted to receive an instrument, Body 400 has a finger shelf 414 extending radially and downwardly from bottom portion 420 of body 400, forming a finger shelf upper surface 446 sized to receive the dorsal surface of the terminal phalanx of the middle finger of the hand, This hand position is similar to the hand position shown in FIG. 15*a*.

Body 400 has a front surface 422 in the form of a saddle between finger shelf 414 and top portion 486, with front surface 322 extending to, and merging with, finger shelf upper surface 446. Front surface 422 is sized to receive a lateral surface of the terminal phalanx of the middle finger 468.

Finger shelf upper surface 446 extends from front surface 422 of body 400 by a distance sufficient to extend from the lateral surface to the median of the dorsal surface of the terminal phalanx. Like finger shelf 314 shown in FIG. 15, finger shelf 414 is extended even further, sufficient to extend out by the full width of the middle finger, approximately 1.4 to 1.5 centimeters from the inner edge 428 of surface 446. The extended length of finger shelf 414 provides extra support for the middle finger, and allows the hand to transmit more force with the middle finger easily.

Figure 18:
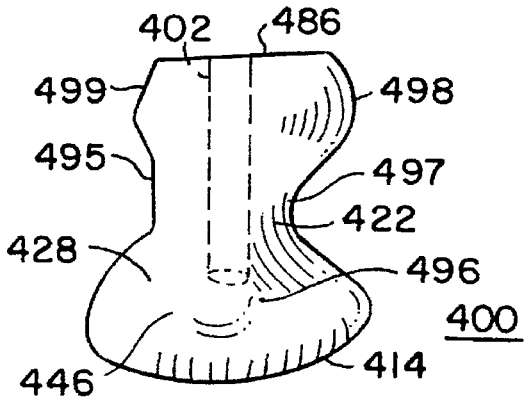
FIG. 18 is a front elevation view of the device shown in FIG. 17.
Figure 19:
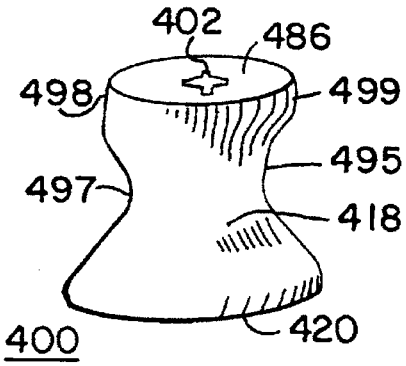
FIG. 19 is a rear elevation view of the device shown in FIG. 17.

As shown in FIG. 18, a concave depression 496 is in the center of finger shelf upper surface 446. When the dorsal surface of the terminal phalanx of the middle finger is received by surface 446, the joint between the middle phalanx and the terminal phalanx is received by concave depression 496, enhancing comfort and increasing the gripping surface. It is understood by those skilled in the art that the position of the concave depression 496 may be shifted slightly towards the left or right of the center of surface 446. In particular, moving depression 496 towards left side 497 provides a larger area on surface 446 on which the terminal phalanx of the middle finger rests while the joint is received by depression 496.

Body 400 has no axis of symmetry. Between the finger shelf 414 and the top portion 486 are front saddle surface 422, side saddle surfaces 495 and 497, and a back saddle surface 488. As shown in FIG. 17, front surface 422 is shallower than back surface 488. The shallower front surface may receive a portion of the lateral surface of the middle phalanx of the middle finger, as well as the terminal phalanx. Back surface 488 is adapted to receive the anterior surface of the terminal phalanx of the first finger.

As shown in FIG. 18, surfaces 495 and 497 differ from one another, to allow more personalized gripping positions. Side surface 497 is relatively deep, to receive the anterior surface or tip of the terminal phalanx of the index finger. Side surface 495 is shallower. The depth of the saddle shaped surface varies between right side 495 and left side 497. By rotating body 400 slightly within the hand, the user can adopt a grip which is most comfortable for him or her.

As shown in FIG. 18, bore 402 is substantially perpendicular to finger shelf surface 446, and is approximately midway between right side 495 and left side 497. A variation of the embodiment of FIG. 18 (not shown) includes a bore which is inclined towards side 499 at the top portion. The off-center bore provides a slightly different writing angle than is provided with the 90 degree angle shown in FIG. 18. The shallow right surface 495 allows placement of bore 402 closer to side 495 without causing any structurally weak zones in body 400.

Figure 20:
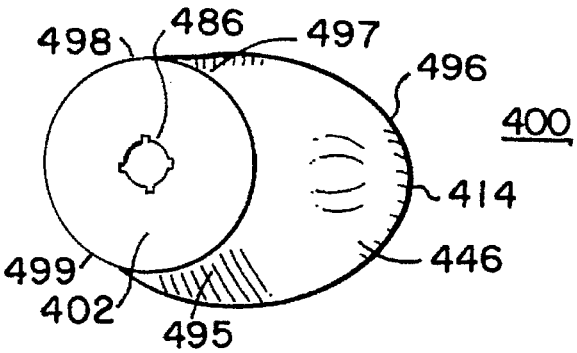
FIG. 20 is a plan view of the device shown in FIG. 17.

As shown in FIG. 20, finger shelf 414 does not extend as far around body 400 as does finger shelf 314 shown in FIG. 16. Because body 400 is hand specific, the larger shelf angular coverage is not required.

Figure 21:
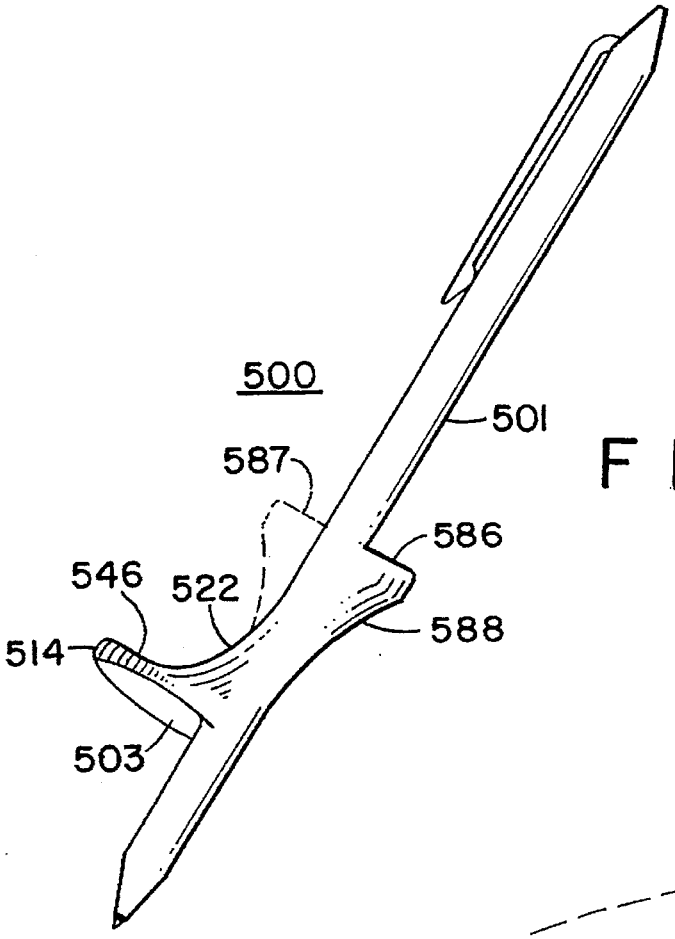
FIG. 21 is a side elevation view of a sixth exemplary embodiment of the invention.
Figure 21A:
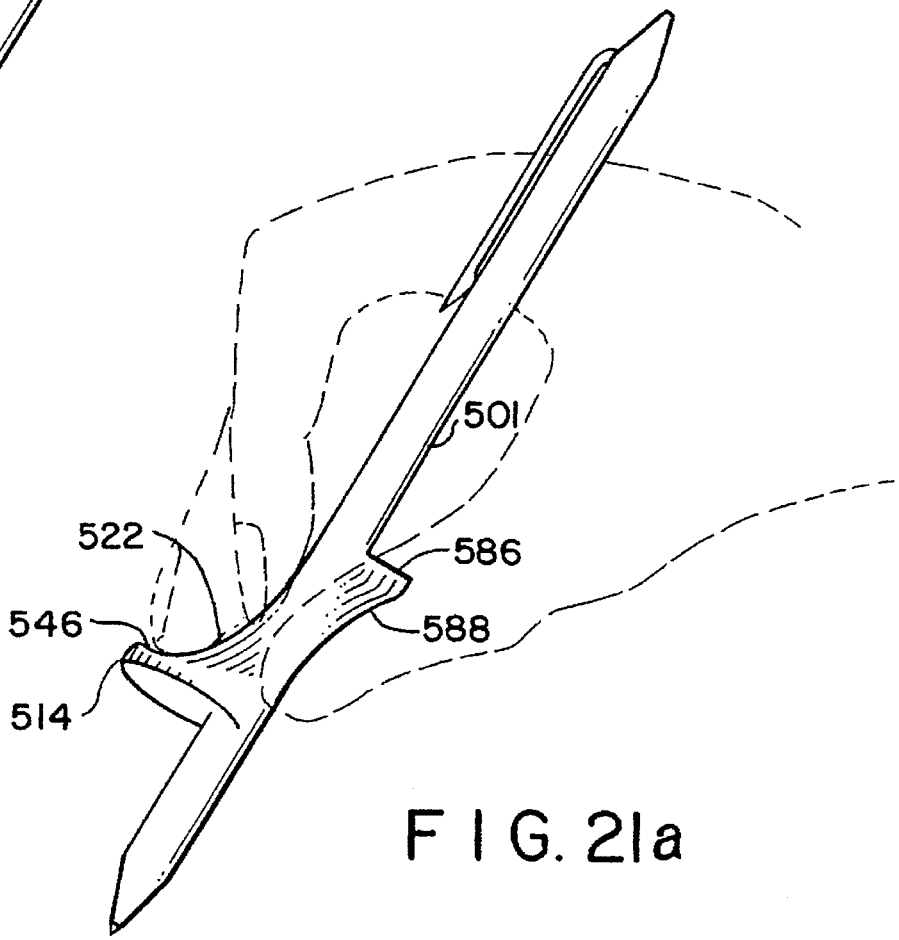
FIG. 21*a* shows a hand holding the device shown in FIG. 21.

FIG. 21 shows a further embodiment of the invention, in which gripping device 503 is pre-configured to include a hand held instrument. The gripping device 503 and the housing 501 or outer barrel of the hand held instrument are merged into a single body 500 with the gripping device. In FIG. 21, housing 501 is the barrel of a writing instrument, which may be a pen or a pencil (e.g., a mechanical pencil). Body 503 includes a finger shelf 514 with an upper surface 546 adapted to receive the dorsal surface of the terminal phalanx of the middle finger, as shown in FIG. 21*a*. A front surface 522 is adapted to receive the lateral surface of the middle finger. On the opposite side of housing 501 from finger shelf 514 is a back surface 588 adapted to receive the anterior surface of the terminal phalanx of the first finger. Surfaces 522, 546 and 588 may be hand specific, similar to surfaces 422, 446 and 488 shown in FIG. 17 through FIG. 20. Surfaces 522, 546 and 588 may also be non hand specific, as shown in FIG. 14 through FIG. 16. Surface 546 of the finger shelf may include a concave depression similar to the finger shelf surface 446 in the embodiment of FIG. 17.

As shown in phantom in FIG. 21, the top portion of body 500 may optionally be constructed to wrap all the way around housing 501, forming an additional surface 587 to assist in gripping body 500.

Figure 22:
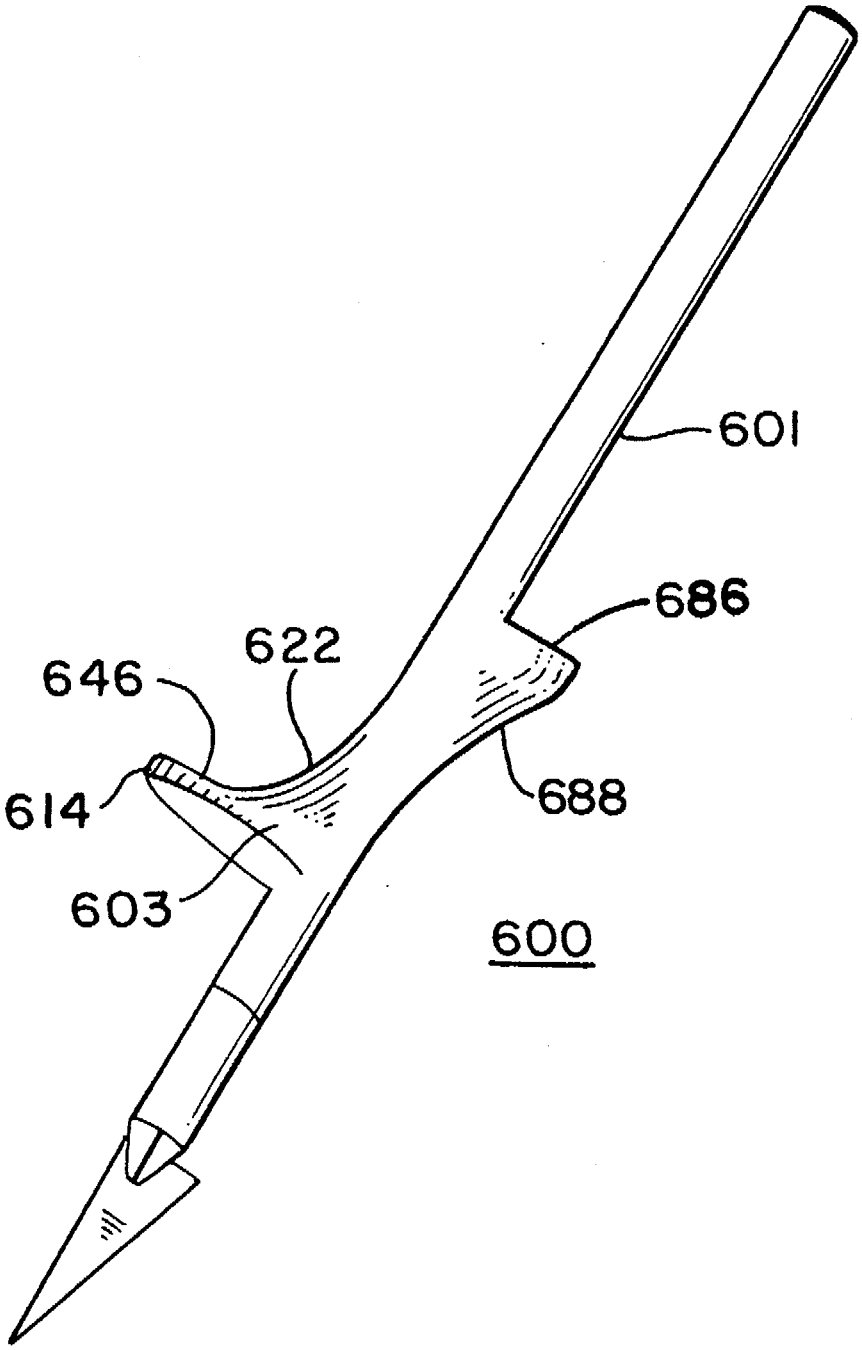
FIG. 22 shows a variation of the embodiment shown in FIG. 21.

FIG. 22 shows a variation of the embodiment of FIG. 21. In FIG. 22, instrument 601 is a cutting instrument, which may be a knife (as shown) or other surgical or dental instrument. It is understood by those skilled in the art that a variety of gripping devices may be manufactured in this manner, with any one of a variety of hand held instruments integrated into the respective gripping device bodies. These instruments may include, but are not limited to eating utensils, tools, toothbrushes, and paintbrushes.

Figure 23:
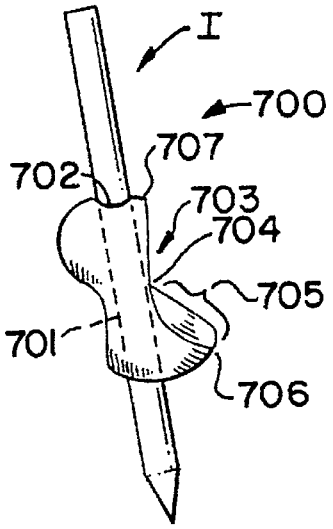
FIG. 23 is a perspective view of still another embodiment of a holding device incorporating the principles of the present invention and showing the manner in which an instrument is supported thereby.

FIG. 23 shows still another embodiment of the present invention which is extremely advantageous for use by individuals having normal ability in handling and/or gripping instruments and the like as well as those having less than normal skills and is extremely advantageous for use by persons constantly performing repetitive manual operations with instruments or the like.

FIGS. 23 and 24–26 show another embodiment of the present invention 700 having an elongated bore 701 terminating in openings 702 and 703 at the respective upper and lower ends thereof. The bore is preferably either cylindrical or may have any other configuration, the holder 700 being formed of a resilient, rubber-like material capable of undergoing some stretching in order to conform to the outer periphery of an instrument having a non-circular shape.

FIG. 23 shows an instrument I which may be a pencil, pen, handle of a cutting knife having a cutting blade (one such hand held cutting instrument being identified by the trademark XACTO).

An instrument I is pushed through bore 701 and can be seen to be of a length which is substantially greater than the length of device 700. Device 700 is positioned at any location along the length of instrument I depending only upon the needs of the user which is based principally upon the comfort and ease of use and holding of the operator. The top end of device 700 has a generally annular shape periphery except for a truncated portion which comprises the top end of a gripping surface 703 which extends downwardly from the top end adjacent opening 702 and curves slightly inwardly in the region 704 and thereafter curves outwardly over the region 705 to form a somewhat J-shaped or "ski-slope" configuration when viewed as a side elevation. The lower end forms a curved edge or vertex 706 of the gripping surface which extends outwardly from the bore 701 by a distance greater than the upper end 707.

The upper region of the gripping surface 703 extending from top 707 to about the intermediate portion thereof is substantially flat and parallel to axis A while the remaining surface from the intermediate portion to the bottom edge 706 has a substantially curved concave surface gradually extending downwardly and away from axis A.

The device 700 tapers gradually downwardly from the top toward a narrower intermediate or "waist" region 708 and then tapers outwardly from the intermediate region toward the bottom of the device 700 which curves radially inwardly to merge with the perimeter of bottom opening 703. Device 700, excluding the gripping surface 703, has a generally "hour glass" shape comprised of top and bottom portions which gradually taper radially inwardly to define the waist portion.

The intermediate region on the sides adjacent gripping surface 703 and the portion thereof between said sides and opposite said gripping portion 703 is of reduced diameter, the taper being a gradual curvature. The intermediate surface region thus has a curved concave contour. The surface 709 opposite the gripping surface 703 tapers inwardly a slightly greater amount than the side surfaces 708*a*, 708*b* shown in FIG. 25.

Some of the possible arrangements which may be utilized to grip device 700 are shown in FIGS. 23A–23D.

Figure 23A:
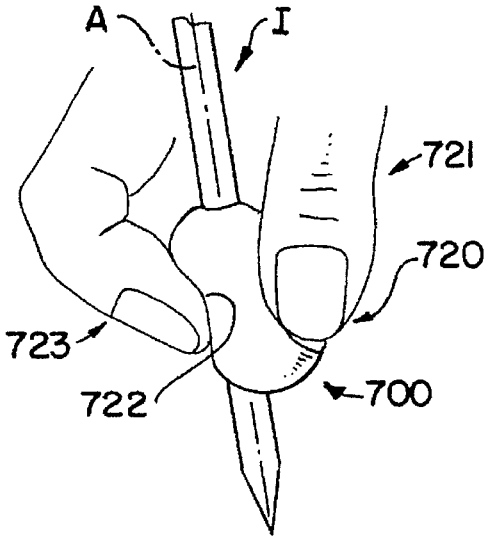
FIG. 23A shows one arrangement for holding the device of FIG. 23 by a right hand of an operator.

FIG. 23A shows one manner in which device 700 may be gripped by one finger and a thumb of a right hand. More specifically, the interior surface 720 of the terminal phalanx of thumb 721 presses on the lower concave surface portion of gripping surface 703 while the anterior surface 722 of the terminal phalanx of index finger 723 rests upon the surface area 709 of reduced diameter. The forces exerted by thumb 721 and index finger 723 in the direction extending radially inwardly toward instrument I need only be minimal and in fact is substantially negligible. The forces exerted by index finger 723 and thumb 721 and principally thumb 721 in a direction parallel to the longitudinal axis A of instrument I is significantly greater than the force needed to grip the device 700 and hence instrument I. This is made possible due to the fact that the concave curvature of the rear surface portion 709 cooperates with the gripping surface 703 to prevent the device 700 and hence instrument I from moving either upwardly or downwardly. The operator may therefore concentrate principally upon the application of force necessary to press the instrument upon a sheet of paper or to perform some other operation such as cutting, scraping, pushing, pulling or the like.

Figure 23C:
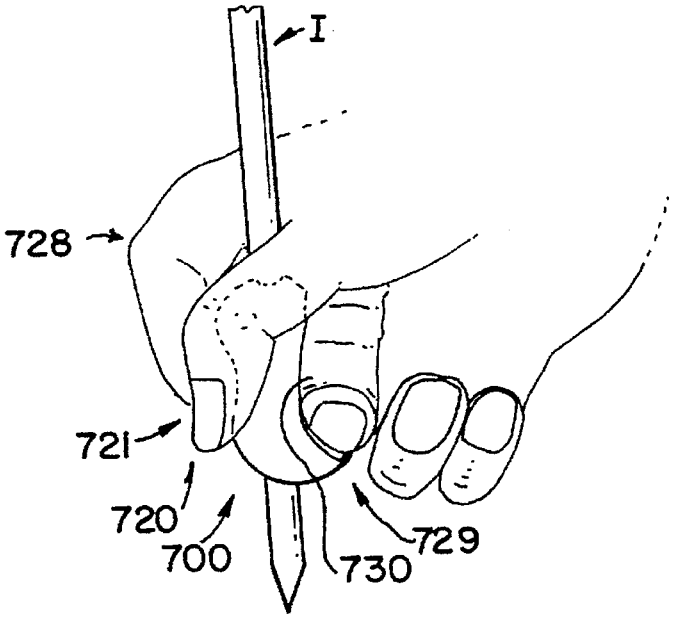
FIG. 23C shows still another arrangement for holding the device of FIG. 23 utilizing a right hand.
Figure 23B:
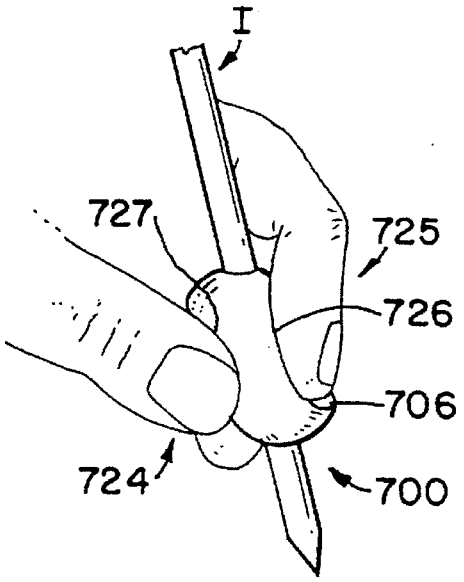
FIG. 23B shows another arrangement for holding the device of FIG. 23 utilizing a left hand of an operator.

FIG. 23*b* shows the device 700 holding instrument I and being gripped by the thumb 724 and index finger 725 of an operator's left-hand. More specifically, the anterior surface 726 of the terminal phalanx of index finger 725 rests along nearly the entire gripping surface 703 from the top thereof to nearly the bottom edge 706, the gripping surface having a contour which substantially conforms to the shape of the anterior surface of the index finger resting thereon.

The anterior surface 727 of the terminal phalanx of thumb 724 engages the intermediate portion 709 of the back surface and the intermediate portion 708*b* of the right-hand surface. Similar to FIG. 23A, the force exerted radially inwardly by thumb 724 and finger 725 is minimal and substantially insignificant, due to the unique contour of device 700. In contrast, the downward force, i.e. the force exerted parallel to the longitudinal axis A of instrument I is significantly greater and is principally a function of the nature of the instrument being manipulated and the operation being performed. For example, a writing instrument such as a pen (either a ball point or a nib-type pen) or pencil requires only a light downward force whereas a cutting instrument, an artist's or leather worker's tool or a dental instrument such as a dental pick may require a greater (pushing or pulling) force.

Device 700 is extremely advantageous for use in instances where repeated operations over a long period of time would otherwise cause significant strain and/or fatigue experienced due to use of the normal forces required to press a pen or pencil, for example, between the thumb and index and third fingers. Alternatively, persons lacking the ability to provide such normal pressing forces may nevertheless have the ability to hold the instrument while exerting an insignificant if not imperceptible pressing force.

FIG. 23C shows still another arrangement in which device 700 is gripped by the thumb 721, index finger 728 and third or middle finger 729 of an operator's right hand. More specifically, the dorsal surface of the terminal phalanx 730 engages gripping surface 703. The interior surface and a portion of the side surface between the interior and dorsal surface of the terminal phalanx 720 of thumb 721 engages the rear intermediate surface 709 (see FIG. 25) and may also rest somewhat on the surface portion 708*b*. Middle finger 728 need not even engage the device 700 and, merely as a matter of an operator holding the fingers in a comfortable position, finger 28 may touch only the anterior surface of the terminal phalanx of thumb 721 or alternatively may touch upon the regions 708*a* of device 700 or may touch upon portions of the thumb 721 and device 700 mentioned immediately hereinabove.

Again, the pressing force required to be exerted upon device 700 by the fingers and thumb in the inward radial direction is substantially insignificant for the reasons set forth hereinabove while, in contrast, the downward force exerted in the direction parallel to the longitudinal axis of instrument I is significantly greater than any inward radial force exerted on the instrument and is a function of the nature of the operation being performed, as was described hereinabove. In addition, the principal downward force may be exerted by and is preferably exerted by the middle finger 729.

As a modification of the arrangement shown in FIG. 23C, the knuckle portion of the finger 729 between the terminal phalanx and the intermediate phalanx may engage and rest upon the gripping surface 703 and more specifically the lower, concave, curved region 705 (see FIG. 23). Alternatively, both a portion of the dorsal surface of the terminal phalanx finger 729 and the aforementioned knuckle may engage and rest upon gripping surface 703.

Figure 23D:
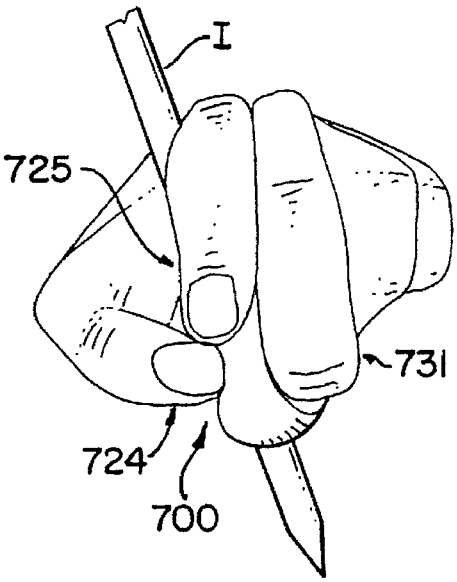
FIG. 23D shows still another manner in which the holding device of FIG. 23 may be gripped by a left hand.
Figure 25:
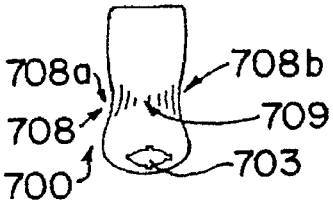
FIG. 25 is a rear elevational view of the holding device of FIG. 23.
Figure 24:
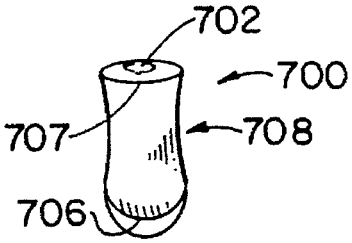
FIG. 24 is a front elevational view of the holding device of FIG. 23.
Figure 26:
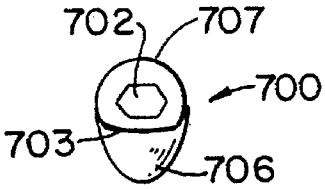
FIG. 26 is a top view of the holding device of FIG. 23.

FIG. 23D shows still another gripping arrangement in which the index and middle or third fingers 725 and 731 and the thumb 724 of a left-hand grips device 700. More specifically, the dorsal surface of the terminal phalanx of the middle finger 731 rests upon the lower surface portion 705 of gripping surface 703. The anterior surface of the terminal phalanx of thumb 724 rests upon surface portion 709. The anterior surface of the terminal phalanx of index finger 725 rests upon surface portion 708*b*. The forces required to manipulate instrument I may be obtained principally from middle finger 731 and thumb 724 and the positioning of the index finger 705 may be more a matter of placement in the manner shown in FIG. 23D for purposes of comfort more so than for purposes of urging instrument I toward (or away from) a surface being worked upon. The anterior surface portion of index finger 725 may rest exclusively upon an engaging surface of thumb 724 or exclusively upon surface 708*b* of device 700 or may rest upon partial surfaces of both the device 700 and thumb 724. The principal downward forcing exerted upon instrument I may be derived from the middle finger 731. As an alternative to the arrangement shown in FIG. 23D, the knuckle portion of finger 731 located between the terminal phalanx and the middle phalanx may rest upon the lower portion of 705 of gripping surface 703. As a further alternative, the dorsal surface of the middle phalanx of middle finger 731 may rest upon surface portion 705. Any of these alternative holding arrangements may be utilized with equal success in holding instrument I for the performance of a given operation. In addition, an operator may shift from one gripping arrangement to another as a means for reducing discomfort, strain and the like. A number of the gripping arrangements described for use with the embodiments of FIGS. 1–22 may also be used.

Figure 27:
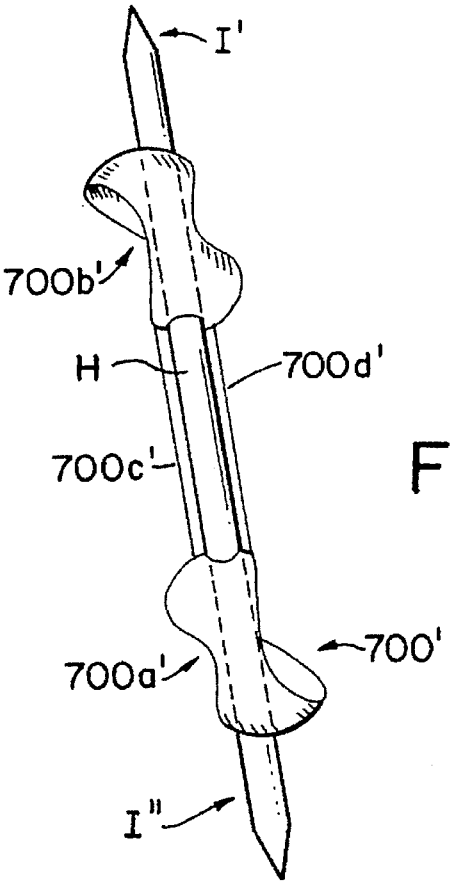
FIG. 27 is a perspective view showing a modification of the embodiment of FIG. 23.

FIG. 27 shows an alternative embodiment 700' of the device shown, for example, in FIG. 23 wherein opposite end portions 700*a*', 700*b*' are substantially identical in design and function to the device 700 shown in FIG. 23 and wherein the portions 700*a*' and 700*b*' are joined by at least and preferably two joining strips 700*c*', 700*d*'. This embodiment is extremely useful in conjunction with dental and other instruments wherein different types of implements are provided at opposite ends of a common handle H having instrument ends I' and I". This arrangement enables an operator to switch the use of one instrument I' to the other instrument I" without removing and reversing a single device 700. As further alternatives, connector strips 700*c*' and 700*d*' may be replaced by a continuous, cylindrical arrangement or alternatively may be eliminated altogether, thereby effectively providing two independent devices 700*a*' and 700*b*'.

Although the descriptions and illustrations above contain numerous specifications and illustrations for use, these should not be construed as limiting the scope of the invention but as merely providing illustrations of some of the presently preferred embodiments of this invention.

What is claimed is:

1. In combination, a hand-held device and an instrument, said hand-held device for aiding in the gripping of said instrument, said instrument having an elongated body shaped to be normally held by pressing at least two fingers of a user's hand against the elongated body and without any additional member which aids in holding the instrument and having an operating portion extending from one end of the elongated body for performing an operation, said device comprising:

a single, one-piece body having first and second ends;

a bore extending in a longitudinal direction between said first and second ends and terminating in respective openings in said first and second ends;

said instrument having a length greater than a length of said device;

said device removably receiving the elongated body of said instrument which is inserted into said bore so that at least the operating portion extends beyond the first end and an end of the elongated body opposite said operating portion extends beyond said second end;

at least said openings frictionally engaging said elongated body of said instrument to firmly retain said device at a selected portion along the length of said elongated body;

said one-piece body having a single support shelf at the first end and having a generally hour-glass shape on two opposing sides, one of said two opposing sides being expanded at said first end to form said support shelf for supporting a portion of a single finger;

two remaining sides of said device having generally flat surfaces; and said two remaining sides and a remaining one of the opposing sides having a generally hour glass shape serving as single or plural finger support surfaces.

* * * * *